US010211529B2

(12) United States Patent
Haskell et al.

(10) Patent No.: US 10,211,529 B2
(45) **Date of Patent: *Feb. 19, 2019**

(54) PHASED ARRAY ANTENNA SYSTEM WITH ELECTRICAL TILT CONTROL

(71) Applicant: Quintel Technology Limited, Bristol (GB)

(72) Inventors: Philip Edward Haskell, Bristol (GB); Louis David Thomas, Bristol (GB)

(73) Assignee: Quintel Technology Limited, Bristol (GB)

( * ) Notice: Subject to any disclaimer, the term of this patent is extended or adjusted under 35 U.S.C. 154(b) by 268 days.

This patent is subject to a terminal disclaimer.

(21) Appl. No.: 15/012,363

(22) Filed: Feb. 1, 2016

(65) Prior Publication Data

US 2016/0352010 A1 Dec. 1, 2016

Related U.S. Application Data

(62) Division of application No. 12/514,287, filed as application No. PCT/GB2007/004227 on Nov. 7, 2007, now Pat. No. 9,252,485.

(30) Foreign Application Priority Data

Nov. 10, 2006 (GB) ..... 0622411.7

(51) Int. Cl.
*H01Q 3/00* (2006.01)
*H01Q 3/26* (2006.01)
(Continued)

(52) U.S. Cl.
CPC ..... *H01Q 3/2694* (2013.01); *H01Q 3/30* (2013.01); *H01Q 3/36* (2013.01); *H01Q 21/22* (2013.01);
(Continued)

(58) Field of Classification Search
CPC ..... H01Q 3/2694; H01Q 3/26; H01Q 3/2676; H01Q 3/2682; H01Q 3/30; H01Q 3/34; H01Q 3/36; H01Q 3/38; H01Q 21/22
(Continued)

(56) References Cited

U.S. PATENT DOCUMENTS 3,295,134 A * 12/1966 Lowe ..... H01Q 3/40 333/101
3,474,447 A 10/1969 Melancon
(Continued)

FOREIGN PATENT DOCUMENTS

EP 0108670 5/1984
GB 2034525 A 6/1980
(Continued)

OTHER PUBLICATIONS

Notification Concerning Transmittal of International Preliminary Report on Patentability for PCT/GB2007/004227; dated May 22, 2009, 8 unnumbered pages.
(Continued)

*Primary Examiner* — Chuong P Nguyen
(74) *Attorney, Agent, or Firm* — Tong, Rea, Bentley & Kim, LLC

(57) ABSTRACT

A phased array antenna system with electrical tilt control incorporates a tilt controller (62) for splitting an input signal into three intermediate signals, two of which are delayed by variable delays T1 and T2 relative to the third. A corporate feed (64) contains splitters S3 to S10 and hybrids H1 to H6 for processing the intermediate signals to produce drive signals for elements of an antenna array (66); the drive signals are fractions and vector combinations of the intermediate signals. The tilt controller (62) and the corporate feed (64) in combination impose relative phasing on the drive signals as appropriate for phased array beam steering
(Continued)

in response to variable delay of two intermediate signals relative to the third intermediate signal.

26 Claims, 16 Drawing Sheets

(51) Int. Cl.

| | |
|---|---|
| ***H01Q 3/30*** | (2006.01) |
| ***H01Q 3/36*** | (2006.01) |
| ***H01Q 21/22*** | (2006.01) |
| *H01Q 1/24* | (2006.01) |
| *H01Q 21/00* | (2006.01) |

(52) U.S. Cl.
CPC ..... *H01Q 1/246* (2013.01); *H01Q 3/26* (2013.01); *H01Q 21/0006* (2013.01)

(58) Field of Classification Search
USPC ..... 342/354, 368, 372, 375, 380, 381, 383, 342/384; 343/777, 778; 455/63.4, 562.1
See application file for complete search history.

(56) References Cited

U.S. PATENT DOCUMENTS

| | | | | |
|---|---|---|---|---|
| 4,862,116 | A | 8/1989 | Olver | |
| 5,861,845 | A * | 1/1999 | Lee | H01Q 3/22 342/374 |
| 6,188,373 | B1 * | 2/2001 | Martek | H01Q 1/246 342/375 |
| 6,667,714 | B1 * | 12/2003 | Solondz | H01Q 1/246 342/368 |
| 6,864,837 | B2 * | 3/2005 | Runyon | H01Q 1/246 342/372 |
| 7,230,570 | B2 * | 6/2007 | Thomas | H01Q 1/246 342/372 |
| 7,365,695 | B2 | 4/2008 | Thomas et al. | |
| 7,420,507 | B2 * | 9/2008 | Thomas | H01Q 1/246 342/368 |
| 7,450,066 | B2 | 11/2008 | Haskell | |
| 7,683,833 | B2 | 3/2010 | Floyd et al. | |
| 7,911,383 | B2 * | 3/2011 | Haskell | H01Q 3/36 342/372 |
| 8,185,162 | B2 | 5/2012 | Haskell et al. | |
| 8,384,597 | B2 * | 2/2013 | Manholm | H01Q 1/246 343/700 R |
| 8,798,679 | B2 * | 8/2014 | Shimizu | H01Q 1/246 343/758 |
| 9,049,083 | B2 * | 6/2015 | He | H01Q 1/246 |
| 9,118,361 | B2 * | 8/2015 | Barker | H04B 7/0408 |
| 10,033,086 | B2 * | 7/2018 | Ding | H01Q 3/04 |
| 2003/0043071 | A1 * | 3/2003 | Lilly | H01Q 3/22 342/368 |
| 2009/0322610 | A1 * | 12/2009 | Hants | H01Q 3/2694 342/372 |
| 2010/0144289 | A1 * | 6/2010 | Haskell | H01Q 1/246 455/83 |
| 2011/0102262 | A1 * | 5/2011 | Haskell | H01Q 1/246 342/372 |

FOREIGN PATENT DOCUMENTS

| | | | |
|---|---|---|---|
| JP | 2001-223525 | | 8/2001 |
| JP | 2005-522062 | A | 5/2003 |
| JP | 2006-029719 | A | 2/2006 |
| WO | WO 2004/102739 | A | 11/2004 |
| WO | WO 2005/048401 | A | 5/2005 |

OTHER PUBLICATIONS

First Office Action for Chinese Patent Application No. 200780049659.4, dated Feb. 29, 2012, 10 pages.
English Translation of Japanese Office Action for Japanese Patent Application Serial No. 2009-535790, dated Apr. 28, 2012, 10 pages.
EP Examination Report from corresponding EP Application No. 07 824 462.1 dated Feb. 9, 2017, 7 pages.

* cited by examiner

Three Phase Shifters, Total Delay = 6T

Prior art Fig.2(B)

Four Phase Shifters, Total Delay = 5T

Four Phase Shifters, Total Delay = 4T

Prior art Fig.2(D)

Four Phase Shifters, Total Delay = 3T

Three Phase Shifters, Total Delay = 3T

Four Phase Shifters, Total Delay = 4T

Four Phase Shifters, Total Delay = 4T, Five Elements

PHASED ARRAY ANTENNA SYSTEM WITH ELECTRICAL TILT CONTROL

This application is a divisional of U.S. patent application Ser. No. 12/514,287, filed May 8, 2009, now U.S. Pat. No. 9,252,485, which was filed as application No. PCT/GB07/04227, filed Nov. 7, 2007, which claimed priority to GB 0622411.7, which was filed on Nov. 10, 2006. Each of the above applications is herein incorporated by reference in its entirety.

The present invention relates to a phased array antenna system with electrical tilt control. The antenna system is suitable for use in many phased array applications in telecommunications and radar, but finds particular application in (although it is not limited to) cellular mobile radio networks, commonly referred to as mobile telephone networks. More specifically, but without limitation, the antenna system of the invention may be used with second generation (2G) mobile telephone networks such as the GSM, CDMA (IS95), D-AMPS (IS136) and PCS systems and third generation (3G) mobile telephone networks such as the Universal Mobile Telephone System (UMTS), and other cellular systems.

Phased array antennas for use in cellular mobile radio networks are known: such an antenna comprises an array (usually eight or more) individual antenna elements such as dipoles or patches. The antenna has a radiation pattern incorporating a main lobe and sidelobes. The centre of the main lobe is the antenna's direction of maximum sensitivity in reception mode and the direction of the centre of its main output radiation beam in transmission mode. It is a well-known property of a phased array antenna that if signals received by antenna elements are delayed by a delay which varies with antenna element distance from an edge of the array, then the antenna main radiation beam is steered towards the direction of increasing delay. The angle between main radiation beam centres corresponding to zero and non-zero variation in delay, i.e. the angle of tilt, depends on the rate of change dT/dx of delay T with distance x across the array: dT/dx may be constant, or may vary somewhat to improve beam characteristics as known in the prior art.

Delay may be implemented equivalently by changing signal phase .φ, hence the expression phased array. The main beam of the antenna pattern can therefore be altered by adjusting the phase relationship between signals fed to antenna elements. This allows the beam to be steered, e.g. to modify an antenna's ground coverage area. In this specification, the terms 'phase shifter' and 'time delay device' or 'delay device' or 'delay' are used synonymously. These terms are used in the telecommunications industry and both phase shifters and time delay devices implement tilt identically at the same frequency.

Operators of phased array antennas in cellular mobile radio networks have a requirement to adjust their antennas' vertical radiation pattern, i.e. the pattern's cross-section in the vertical plane. This is necessary to alter the vertical angle of the antenna's main beam, also known as the "tilt", in order to adjust the coverage area of the antenna. Such adjustment may be required, for example, to compensate for change in cellular network structure or number of base stations or antennas. Adjustment of antenna angle of tilt may be mechanical, electrical or both. An antenna's angle of tilt may be adjusted mechanically (angle of "mechanical tilt") simply by changing the direction in which the antenna or its housing (radome) points. An antenna's angle of "electrical tilt" may be adjusted by appropriate relative delay of antenna element signals.

A phased array antenna system with control of angle of electrical tilt is disclosed by G. E. Bacon, "Variable Elevation Beam-Aerial System for 1½ Meters", IEE Part IIIA, Vol. 93, 1946, pp 539-544. This system incorporates a vertically stacked antenna composed of nine sub-arrays of dipoles. It uses a phase shifter with four nested, concentric loops of feeder cable and a connection to their common centre. A conductor connected to and rotatable about the common centre connects the latter to the four loops; each loop has two ends or outputs connected to a respective pair of sub-arrays located symmetrically about a central sub-array, which is itself connected to the common centre to which an antenna drive signal is fed. Rotating the conductor moves its connections around each loop, which increases the phase at one end of that loop and reduces it at the other. Consequently each pair of sub-arrays has phase reduction at one sub-array and phase increase at the other, the phase shift and its rate of change increase from loop to loop outwardly because they are proportional to loop radius.

When used in a cellular mobile radio network, a phased array antenna's vertical radiation pattern (VRP) has a number of significant requirements:

(a) adequate boresight gain;

(b) a first upper side lobe level sufficiently low to avoid interference to mobiles using a base station in a different cell;

(c) a first lower side lobe level sufficiently high to allow communications in the immediate vicinity of the antenna; and (d) side lobe levels that remain within predetermined limits when the antenna is electrically tilted.

The requirements are mutually conflicting, for example, increasing the boresight gain may increase the level of the side lobes. Also, the direction and level or amplitude of the side lobes may change when the antenna is electrically tilted. A first upper side lobe maximum level, relative to the boresight level, of −18 dB has been found to provide a convenient compromise in overall system performance.

The effect of adjusting the angle of mechanical or electrical tilt is to change the antenna boresight direction, which changes the antenna coverage area.

An antenna which is shared by a number of operators preferably has a respective independently adjustable angle of electrical tilt for each operator: however, this has hitherto resulted in compromises in antenna performance. Boresight gain decreases as the cosine of the angle of tilt due to a reduction in effective antenna aperture (this is unavoidable and happens in all antenna designs). Further reductions in boresight gain may result as a consequence of changing the angle of tilt.

R. C. Johnson, Antenna Engineers Handbook, 3rd Ed 1993, McGraw Hill, ISBN 0-07-032381-X, Ch 20, FIG. 20-2 discloses adjusting a phased array antenna's angle of electrical tilt using a respective variable phase shifter for each antenna element: signal phase can therefore be adjusted as a function of distance across the antenna to vary electrical tilt. The cost of the antenna is high due to the number of variable phase shifters required. Cost reduction may be achieved by applying each individual variable phase shifter or delay device to a respective group of antenna elements instead of to individual elements, but this increases side lobe level. If the antenna is shared, its operators must use a common angle of electrical tilt. Finally, if the antenna is used in a communications system having up-link and down-link at different frequencies (as is common, a frequency division duplex system), the angles of electrical tilt in transmit and receive modes are different.

Phased array antennas also preferably have amplitude taper and phase taper, i.e. variation in amplitude and rate of change of phase across the array. Amplitude taper is primarily responsible for setting antenna side lobe level, but has a secondary effect of reducing gain. Phase taper is primarily responsible for setting angle of electrical tilt, but also reduces antenna gain and increases side lobe level if it is not linear.

Prior art techniques for electrical tilting of phased array antennas using multiple variable phase shifters or delay devices are relatively complex: they result in high cost and weight, and are impractical far antenna sharing by multiple carrier frequencies or for antenna operators each requiring a respective angle of electrical tilt.

Control of an antenna's angle of electrical tilt is disclosed in International Patent Application Nos. WO 03/036756, WO 03/036759, WO 03/043127, WO 2004/088790 and WO 2004/102739. Of these, WO 2004/102739 in particular discloses control of electrical tilt by varying a single time delay or phase difference between a pair of signals: a signal splitting and recombining network forms signal combinations with appropriate phasing for input to respective antenna elements. This approach however has a range of tilt which is smaller than that which is desirable for many applications.

It is an object of the present invention to provide an alternative form of phased array antenna system.

The present invention provides a phased array antenna system with electrical tilt control operative as a transmitter in transmit mode and incorporating:

a) an array of antenna elements;

b) tilt control means for splitting an input signal into at least first, second and third intermediate signals such that the at least first and second intermediate signals are each variably delayable relative to the third intermediate signal;

c) corporate feed means for processing the intermediate signals to produce drive signals for antenna elements, the drive signals at least partly comprising vector combinations of the intermediate signals; and d) relative phasing for the drive signals imposed in combination by the tilt control means and the corporate feed means as appropriate for phased array beam steering in response to variable delay of the at least first and second intermediate signals relative to the third intermediate signal.

In another aspect, the present invention provides a phased array antenna system with electrical tilt control operative as a receiver in receive mode and incorporating:

a) an array of antenna elements;

b) corporate feed means for processing received signals from antenna elements to produce at (east first, second and third intermediate signals at least partly comprising vector combinations of the received signals;

c) tilt control means for converting the intermediate signals into an output signal by variably delaying the at least first and second intermediate signals relative to the third intermediate signal and combining the delayed intermediate signals with the third intermediate signal to provide the output signal; and d) relative phasing for the intermediate signals imposed in combination by the corporate feed means and the tilt control means as appropriate for phased array beam steering in response to variable delay of the at least first and second intermediate signals relative to the third intermediate signal.

The tilt control means may include a respective variable delaying means for variably delaying each of the at least first and second intermediate signals relative to the third intermediate signal, the variable delaying means being arranged to provide delays which vary at like rates, one delay increasing while another reduces. The variable delaying means may apply respective delays which are equal to one another in magnitude.

The corporate feed means may combine signals in neighbouring locations to avoid circuit cross-avers. It may combine intermediate signals in neighbouring locations to produce drive signals for antenna elements and avoid circuit cross-overs.

The tilt control means and the corporate feed means may provide drive signals for antenna elements with a substantially linear phase front across the array. They may provide drive signals for antenna elements with an amplitude taper which suppresses side lobes and a substantially linear phase taper which tilts the beam of the array without compromising beam shape. The tilt control means may be a first tilt control means, and the antenna system may include at least one other tilt control means and filtering means to isolate transmit and/or receive signals of different frequencies and provide a respective independent angle of electrical tilt associated with each tilt control means.

The tilt control means and the corporate feed means may include splitting means implementing an amplitude taper such as a cosine, cosec or Dolph-Chebyshev amplitude taper. They may include splitting means and hybrid combining means for splitting and combining signals and implemented as double box quadrature hybrids and sum and difference hybrids. The tilt control means may include only two variable delaying means for variably delaying only first and second intermediate signals relative to the third intermediate signal. The tilt control means may alternatively include only four variable delaying means for variably delaying only first, second, fourth and fifth intermediate signals relative to the third intermediate signal.

The array of antenna elements may have seven, eleven, fifteen or nineteen antenna elements. Some of the drive signals may be fractions of individual intermediate signals and other drive signals may be vector sums or differences of fractions of two intermediate signals.

In an alternative aspect, the present invention provides a method of operating a phased array antenna system with electrical tilt control as a transmitter in transmit mode, the antenna system incorporating an antenna with an array of antenna elements and the method having the steps of:

a) splitting an input signal into at least first, second and third intermediate signals;

b) variably delaying the at least first and second intermediate signals relative to the third intermediate signal;

c) processing the intermediate signals to produce drive signals for antenna elements, the drive signals at least partly comprising vector combinations of the intermediate signals; and d) relatively phasing the drive signals as appropriate for phased array beam steering in response to variable delay of the at least first and second intermediate signals relative to the third intermediate signal.

In a further alternative aspect, the present invention provides a method of operating a phased array antenna system with electrical tilt control as a receiver in receive mode, the antenna system incorporating an antenna with an array of antenna elements and the method having the steps of:

a) processing received signals from antenna elements to produce at least first, second and third intermediate signals at least partly comprising vector combinations of the received signals;

b) converting the intermediate signals into an output signal by variably delaying the at least first and second intermediate signals relative to the third intermediate signal and combining the delayed intermediate signals with the third intermediate signal to provide the output signal; and c) relatively phasing the intermediate signals for phased array beam steering in response to variable delay of the at least first and second intermediate signals relative to the third intermediate signal.

The receive and transmission mode methods may include the step of variably delaying each of the at least first and second intermediate signals relative to the third intermediate signal with delays which vary at like rates, one delay increasing while another reduces. The step of variably delaying may apply respective delays which are equal to one another in magnitude Signals may be combined in neighbouring locations to avoid circuit cross-overs. Intermediate signals may be combined in neighbouring locations to produce drive signals for antenna elements and avoid circuit cross-overs.

Drive signals may be provided for antenna elements with a substantially linear phase front across the array. They may be provided with an amplitude taper which suppresses side lobes and a substantially linear phase taper which tilts the beam of the array without compromising beam shape.

The receive and transmission mode methods may include isolating transmit and/or receive signals of different frequencies and provide independent angles of electrical tilt associated with different tilt controls. They may include signal splitting to implement an amplitude taper such as a cosine, cosec or Dolph-Chebyshev amplitude taper. They may include variably delaying only first and second intermediate signals, or alternatively first, second, fourth and fifth intermediate signals relative to the third intermediate signal in each case.

The array of antenna elements may have seven, eleven, fifteen or nineteen antenna elements. The receive and transmission mode methods may include splitting and combining signals by means of double box quadrature hybrids and sum and difference hybrids. Some of the drive signals may be fractions of individual intermediate signals and other drive signals may be vector sums or differences of fractions of two intermediate signals.

In order that the invention might be more fully understood, embodiments thereof will now be described, by way of example only, with reference to the accompanying drawings, in which:

FIG. 1 shows a phased array antenna's vertical radiation pattern (VRP) with zero and non-zero angles of electrical tilt;

FIGS. 2(A) to 2(D) and FIGS. 3(A) to 3(C) illustrate prior art use of multiple time delay devices for adjusting the angle of electrical tilt of a phased array antenna;

Figure 12:
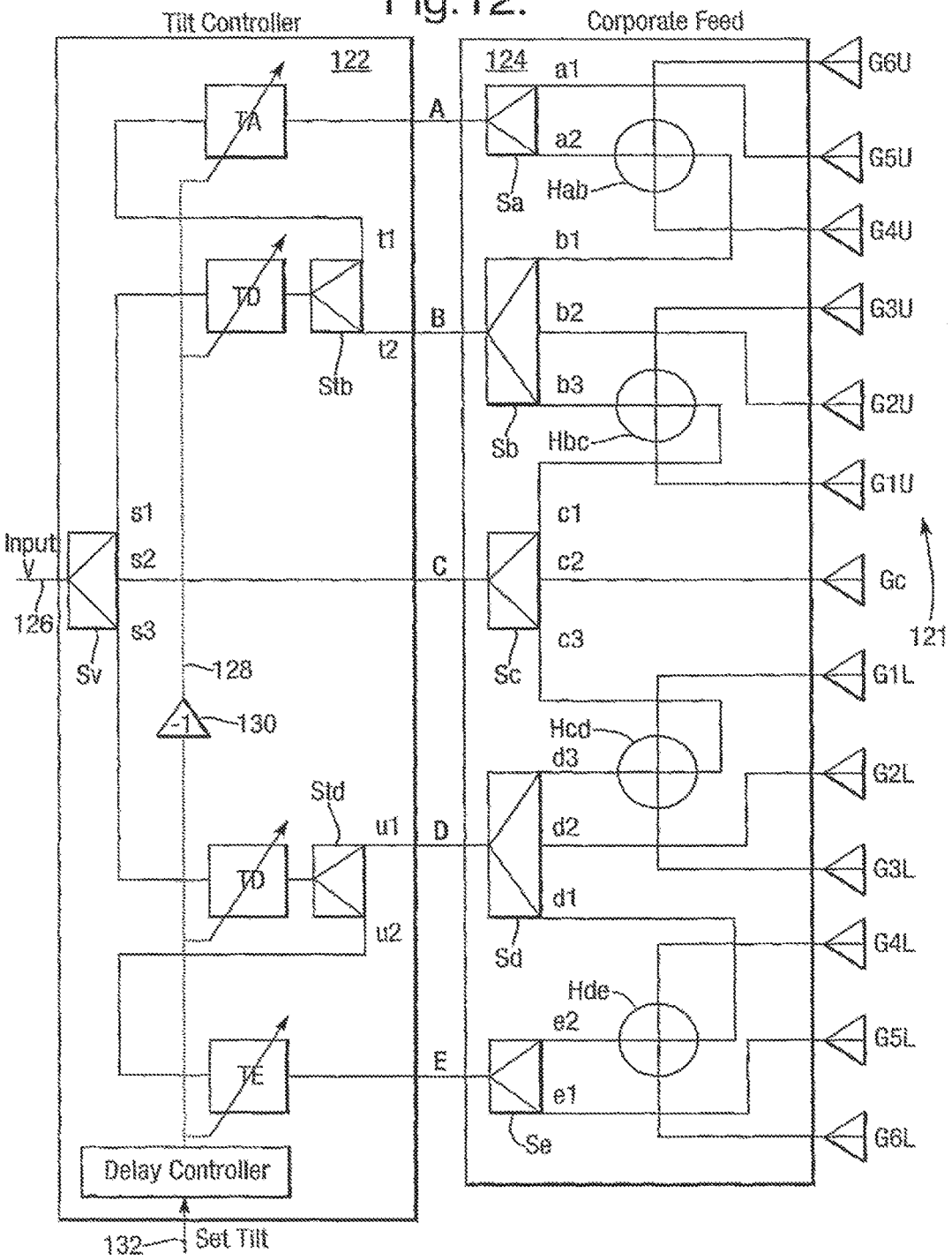
FIG. 12 is a schematic block diagram of a third embodiment of the invention using four variable time delay devices.
Figure 13A:
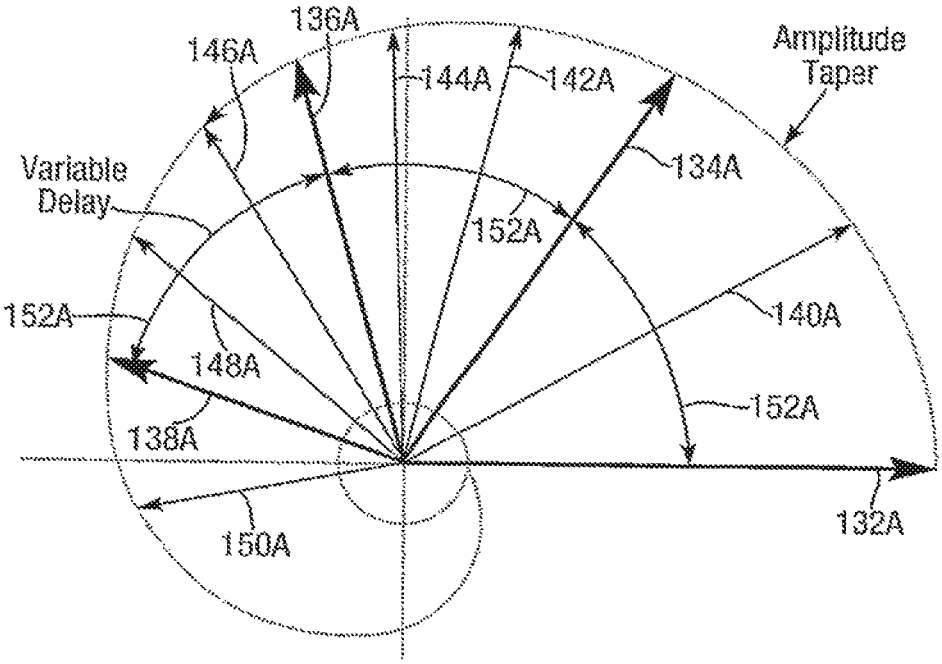
Figure 13B:
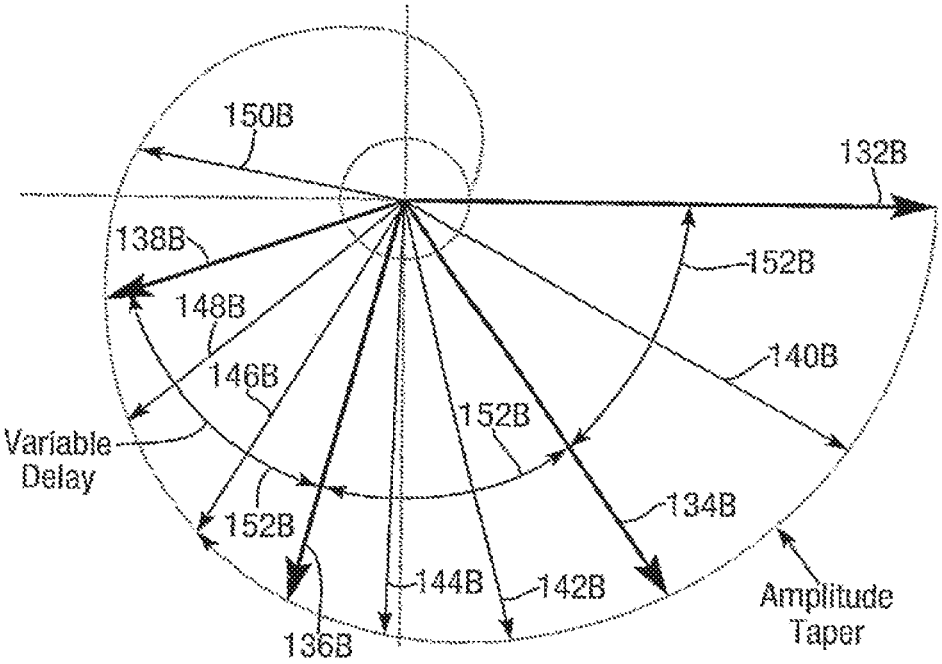
Figure 14:
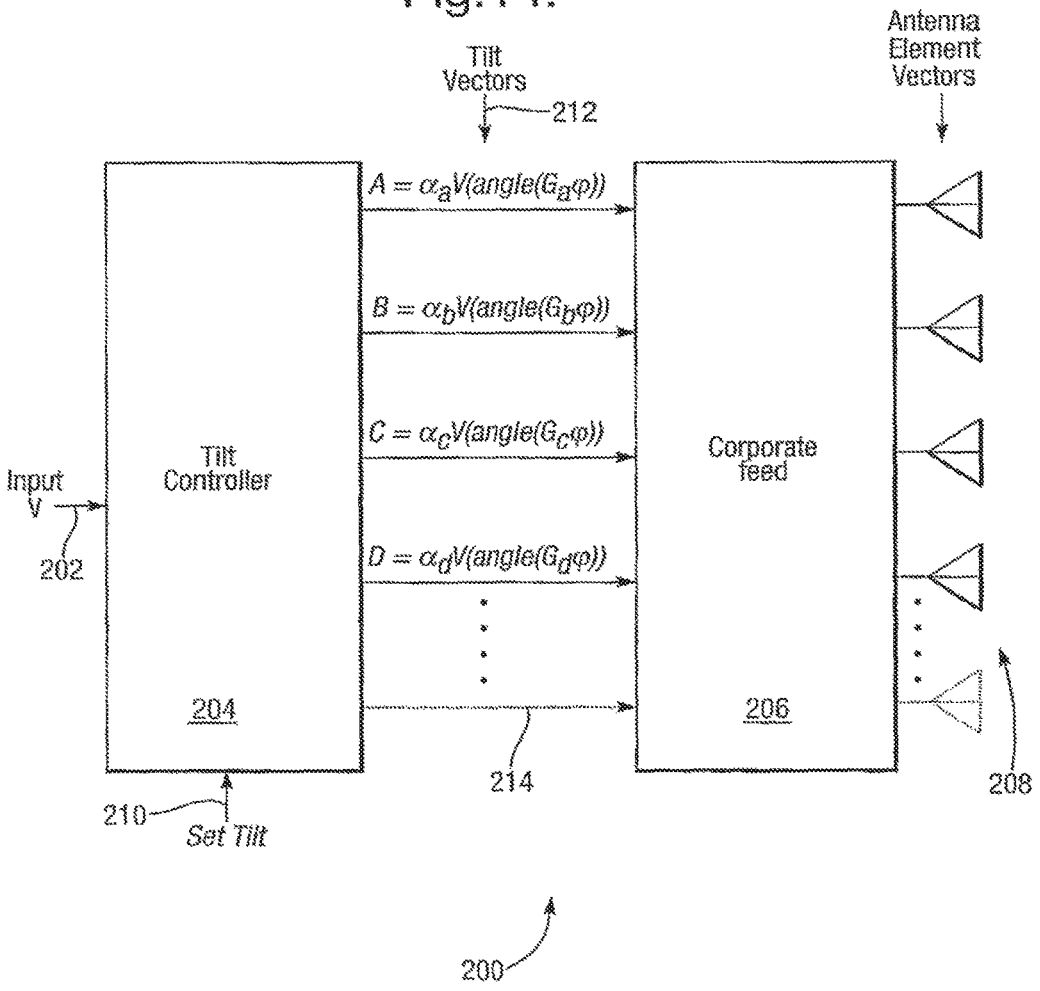
Figure 15:
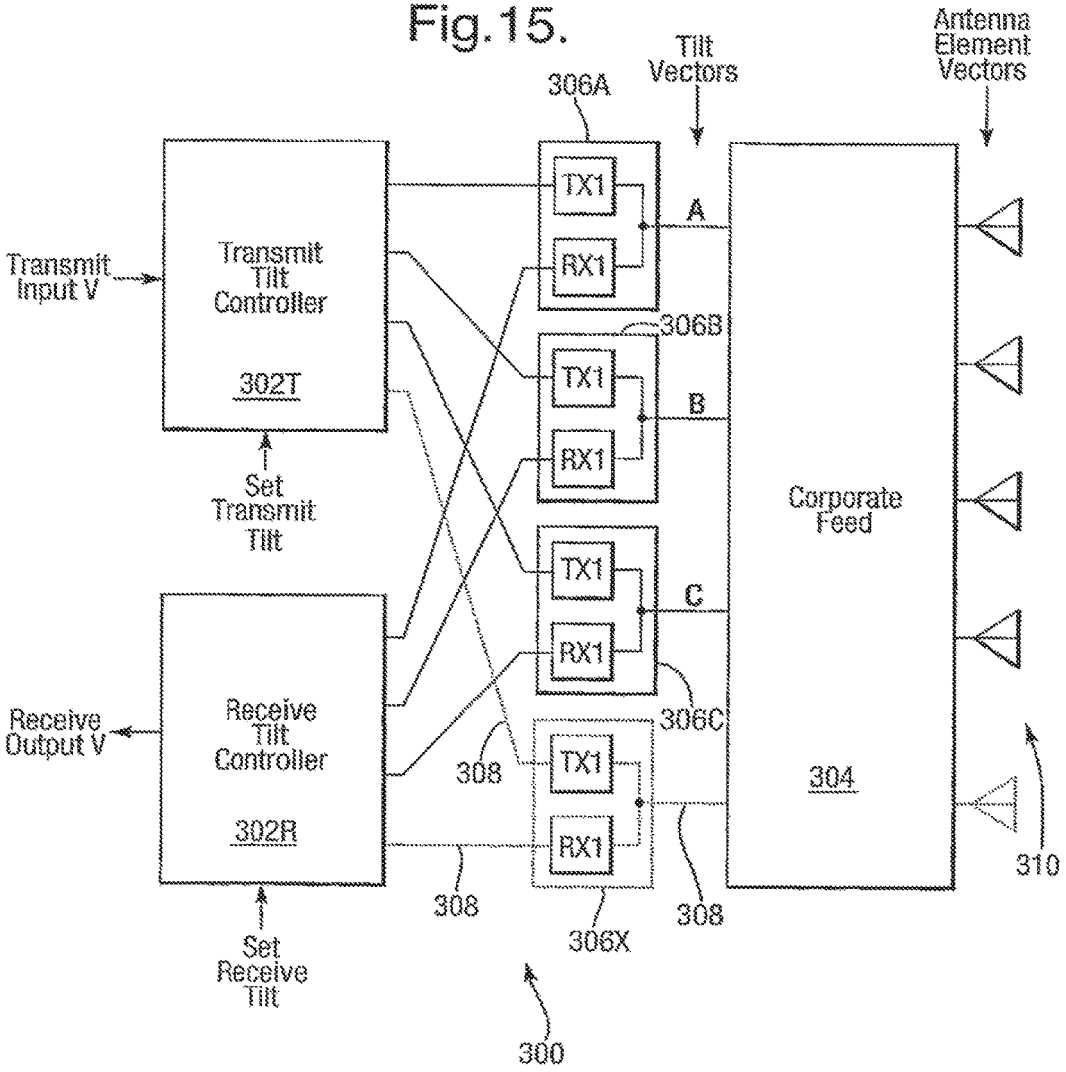
Figure 16:
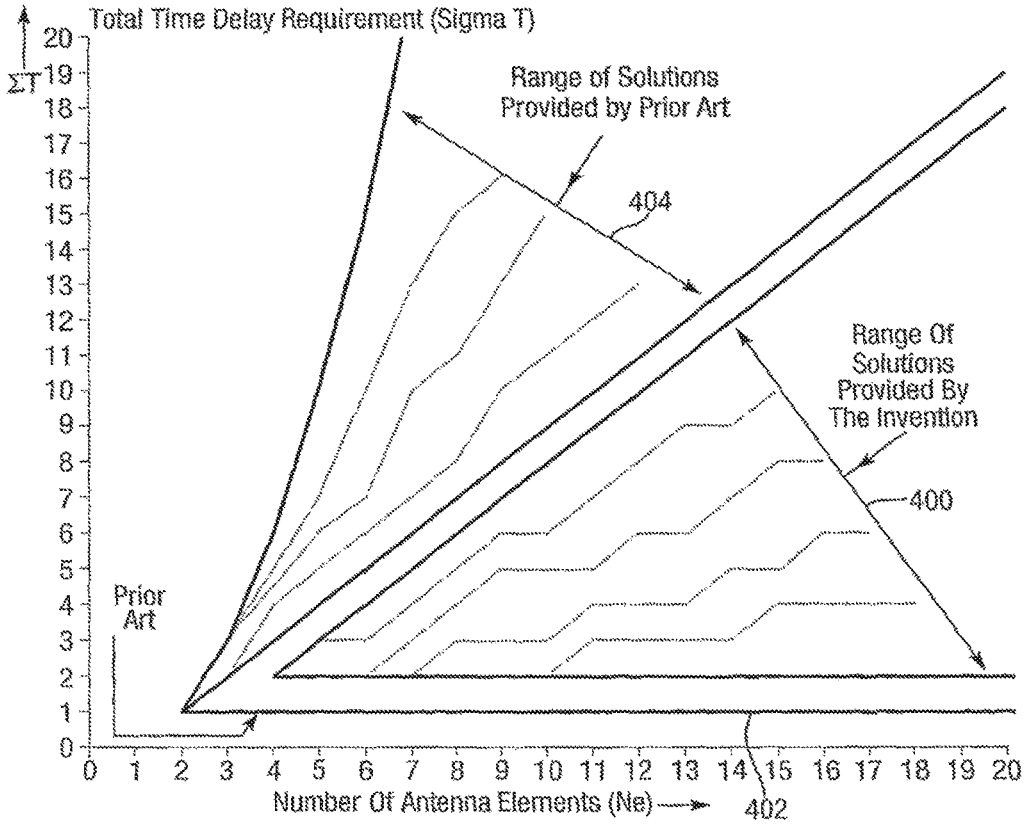

FIGS. 13A to 13B provides two vector diagrams for the embodiment of FIG. 12;

FIG. 14 is a block diagram illustrating the invention implemented with common tilt for both transmit and receive modes of operation;

FIG. 15 is a block diagram illustrating the invention implemented with independently adjustable tilt for transmit and receive modes of operation; and FIG. 16 is a graph of delay requirements versus number of antenna elements comparing delay utilisation of the invention with that of the prior art.

Figure 1:
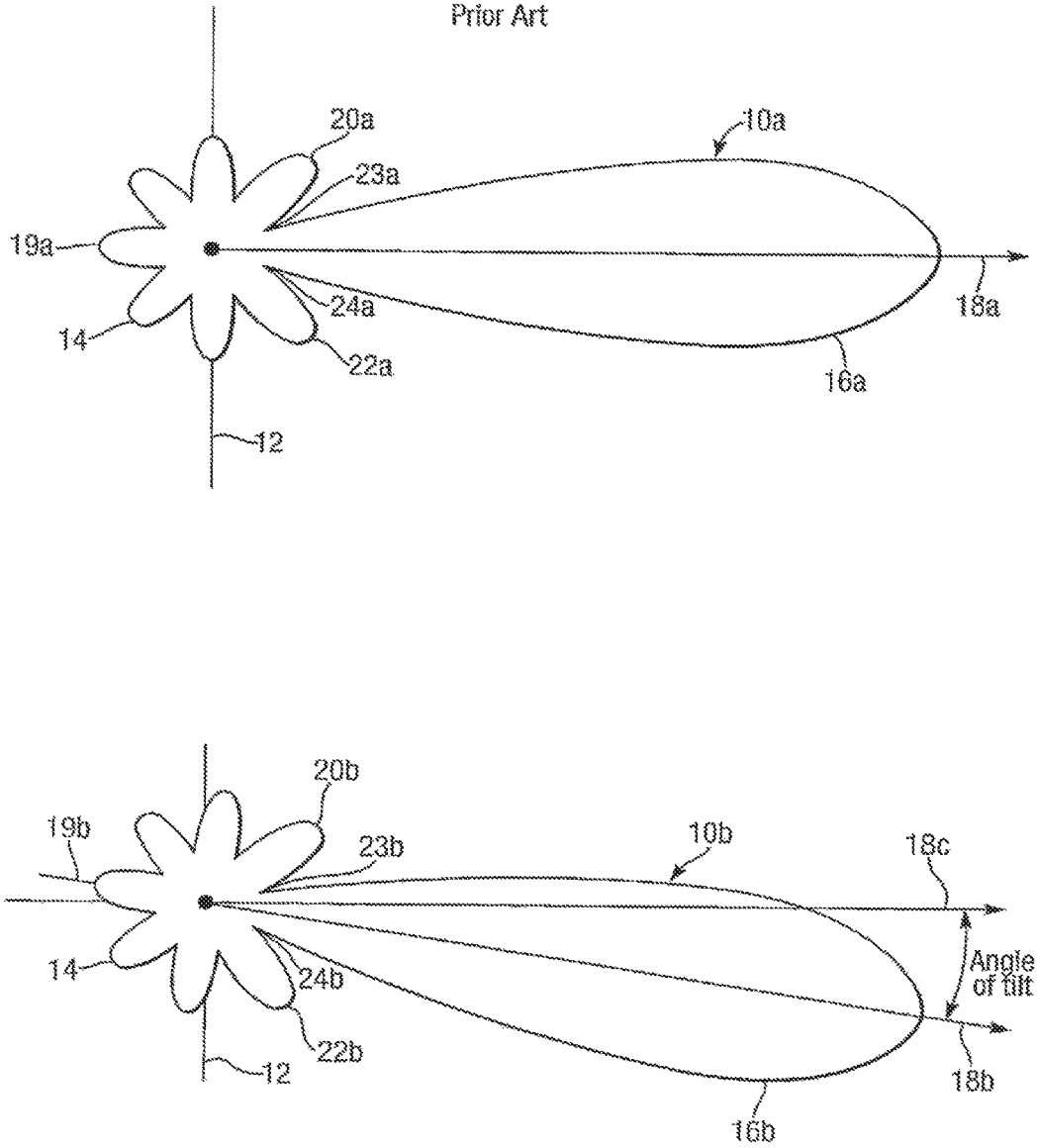
Fig. 1. Prior Art

Referring to FIG. 1, there are shown vertical radiation patterns (VRP) 10*a* and 10*b* of a phased array antenna 12 consisting of an array of antenna elements (not shown). The antenna 12 is linear, has a centre 14 and is disposed vertically in the plane of the drawing. The VRPs 10*a* and 10*b* correspond respectively to zero and non-zero variation in delay or phase of antenna element signals with array element distance across the antenna 12 from an array edge. They have respective main lobes 16*a*, 16*b* with centre lines or "boresights" 18*a*, 18*b*, back lobes 19*a*, 19*b*, first upper sidelobes 20*a*, 20*b*, first lower sidelobes 22*a*, 22*b*, first upper nulls 23*a*, 23*b* and first lower nulls 24*a*, 24*b*; 18*c* indicates the boresight direction for zero variation in delay for comparison with the non-zero equivalent 18*b*. When referred to without the suffix a or b, e.g. sidelobe 20, either of the relevant pair of elements is being referred to without distinction. The VRP 10*b* is tilted (downwards as illustrated) relative to VRP 10*a*, i.e. there is an angle—the angle of electrical tilt—between main beam centre lines 18*b* and 18*c*; the angle of electrical tilt has a magnitude dependent on the rate at which delay varies with distance across the antenna 12 (fundamental principle of a phased array).

The VRP has to satisfy a number of criteria: a) high boresight gain; b) the first upper side Lobe 20 should be at a level low enough to avoid causing interference to mobiles using another base station; and c) the first lower side lobe 22 should be at a level sufficient for communications to be possible in the antenna 12's immediately vicinity. These requirements are mutually conflicting, for example, maximising boresight gain increases side lobes 20, 22. Relative to a boresight level (length of main beam 16), a first upper side lobe level of −18 dB has been found to provide a convenient compromise in overall system performance. Boresight gain decreases in proportion to the cosine of the angle of tilt due to reduction in the antenna's effective aperture. Further reductions in boresight gain may result depending on how the angle of tilt is changed.

The effect of adjusting either the angle of mechanical tilt or the angle of electrical tilt of an antenna is to reposition the boresight relative to a horizontal plane, which adjusts the coverage area of the antenna. For maximum flexibility of use, a cellular radio base station preferably has available both mechanical tilt and electrical tilt, since each has a different effect on ground coverage and also on other antennas in the antenna's immediate vicinity. It is also convenient if an antenna's electrical tilt can be adjusted remotely from the antenna, e.g. to avoid the need to gain access to phase shifters incorporated in an antenna at the top of an antenna support mast. Furthermore, if a single antenna is shared between multiple operators, it is preferable to provide a different angle of electrical tilt for each operator, although this compromises antenna performance in the prior art.

Referring now to FIGS. 2(A) to 2(D) and FIGS. 3(A) to 3(C), these indicate phase shifting/delay arrangements used in prior art phased array antennas to provide adjustable angles of electrical tilt. Antennas with four elements E0 to E3 are shown in each of the seven illustrations in FIGS. 2(A) to 2(D) and 3(A) to 3(D), although phased array antennas may have any number of elements greater than two. Variable delays in series with antenna elements are indicated in each of these illustrations by boxes such as 30 each with a diagonal arrow such as 32 and containing the letter T in some cases multiplied and/or divided by an integer: here T indicates a signal delay time T, NT indicates a signal delay time of N times T, and T/M indicates a signal delay time of T divided by M. In some of these illustrations, a negative signal delay is indicated by a minus sign before T/2 and 3T/2, which cannot be implemented in practice. However, a negative signal delay may be simulated by offsetting all delays in one direction: e.g. delays of +T and −T may be implemented by adding a multiple of T to both and treating their average as a reference zero (a delay which is common to all antenna elements E0 to E3 does not affect angle of tilt). It is however convenient to represent delays as negative where appropriate because it also indicates the sign of the rate of change of delay across the array (which controls tilt).

Also in FIGS. 2(A) to 2(D) and 3(A) to 3(C), dotted lines such as 34 linking arrows 32 indicate variable delays which are ganged (coupled) to vary together; in addition, amplifier symbols (triangles) 36 In dotted lines 34 and marked −1 indicate that delay change implemented above it is in the opposite sense to delay change below it: e.g. in FIG. 3(B), amplifier symbol 36 indicates that when delays in series with antenna elements E0 and E1 increase or reduce, delays in series with antenna elements E2 and E3 reduce or increase respectively. Signals pass from inputs 40 to antenna elements E0 to E3 either undelayed or via one, two or three variable delays.

Figure 2A:
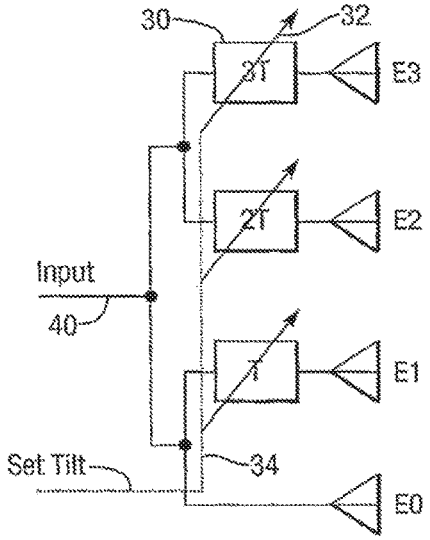
Fig.2(A) Prior art
Figure 2A:
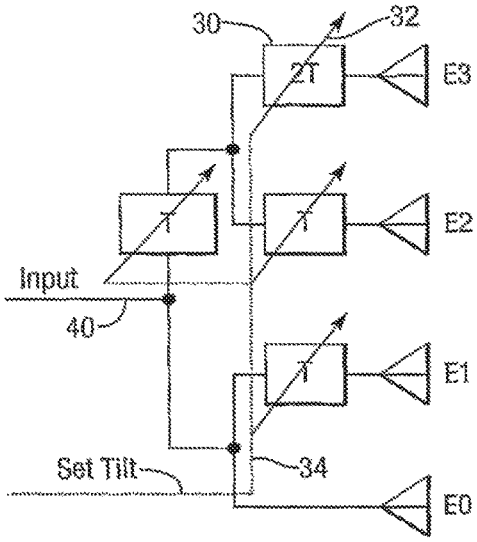
Fig.2(A) Prior art

In FIG. 2(A), antenna element E0 has no series delay, and antenna elements E1 to E3 are in series with ganged variable delays T, 2T and 3T respectively. This provides a delay which increases by T from antenna element En to adjacent antenna element En+1 (n=0 to 2) across the array subject to a maximum delay of 3T and a sum total delay of 6T. The rate of change $d\varphi/dx$ of phase $\varphi$ with distance x across the array is T for x measured in units of spacing between equispaced antenna elements. T is variable for all four elements E0 to E3 in synchrony, as indicated by arrows 32 ganged at 34, so $d\varphi/dx$ and hence electrical tilt can be varied by varying T as indicated by "Set Tilt" in the drawing; (Ne−1) phase shifters are required (i.e. three in this example), i.e. one less than the number Ne of antenna elements. If T has a maximum value of Tmax, the maximum delay is the maximum value of (Ne−1)Tmax (here 3Tmax), and the maximum value of the sum total delay (here 6Tmax) is ½Ne(Ne−1)Tmax. The Bacon reference previously quoted is an example of FIGS. 2(A) to 2(D).

FIG. 2(B) is similar in effect to FIG. 2(A), but the number of variable delays has been increased to four in order to reduce the maximum delay required. As before, antenna element E0 has no series delay, and antenna element E1 has a series delay T; antenna elements E1 to E3 are in series with a common delay T followed in cascade by variable delays T and 2T respectively. All four variable delays are ganged. This provides the same delay varying capability as FIG. 2(A), but with delay variation being 5T in total (reduced from 6T).

Figure 2C:
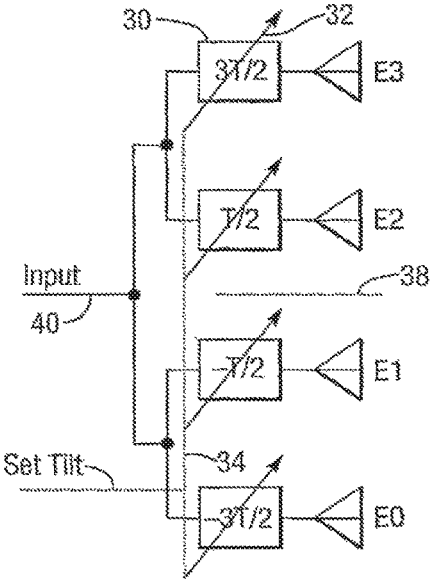
Fig.2(C) Prior art
Figure 2C:
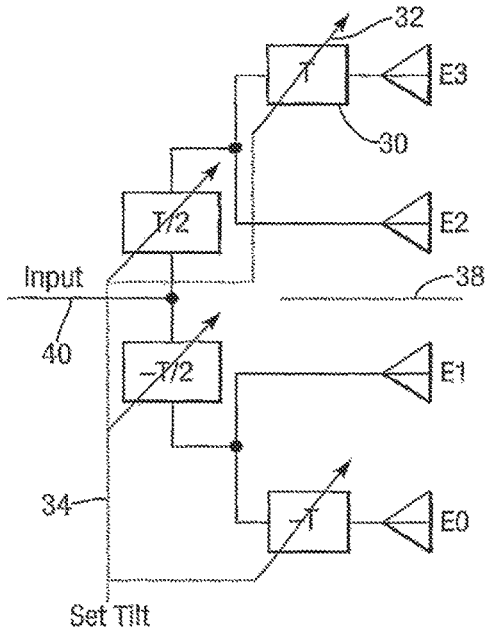
Fig.2(C) Prior art

FIG. 2(C) uses four variable delays, i.e. a separate variable delay for every antenna element E0, E1, E2 and E3 etc., with delays −3T/2, −TI2, T/2 and 3T/2 respectively. A central dotted line 38 corresponds to zero delay. As before, delays are ganged so that they are variable in synchrony: as T increases −3T/2 and −T/2 have higher negative magnitudes, and T/2 and 3T/2 have higher positive magnitudes. Here the delay variation is reduced to 4T.

FIG. 2(D) provides the same delay characteristics as FIG. 2(C), but uses cascaded delays T/2, T and −T/2, −T (similarly to FIG. 2(B) for outer antenna elements E0 and E3 to reduce the maximum delay required. Inner antenna elements E1 and E2 have single delays T/2 in common with respective adjacent elements E0 and E3. As before, delays are ganged. An example of FIG. 2(D) appears in U.S. Pat. No. 5,798, 675, Aug. 25, 1998, and delay variation is now only 3T.

Figure 3A:
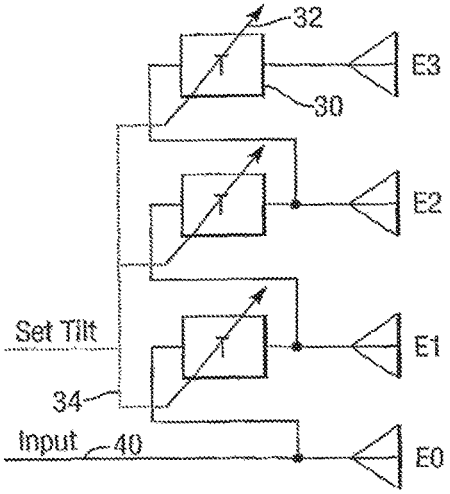
Fig.3(A) Prior art

FIG. 3(A) provides the same delay characteristics as FIG. 2(A) with the same number of delays (3), but makes increased use of cascaded ganged delays all providing delay T. Thus antenna element E0 receives an undelayed signal, whereas antenna elements E1 to E3 receive signals which have passed via one, two and three variable delays summing to T, 2T and 3T respectively. FIG. 3(A) is an alternative to FIG. 2(A) in having a total delay requirement of 3T but with delays 'daisy chained' together: consequently like values of delay can be used. It has the problem that it necessitates use of an asymmetrical corporate feed which requires undesirably high values of signal splitter ratios in order to implement an amplitude taper.

Figure 3B:
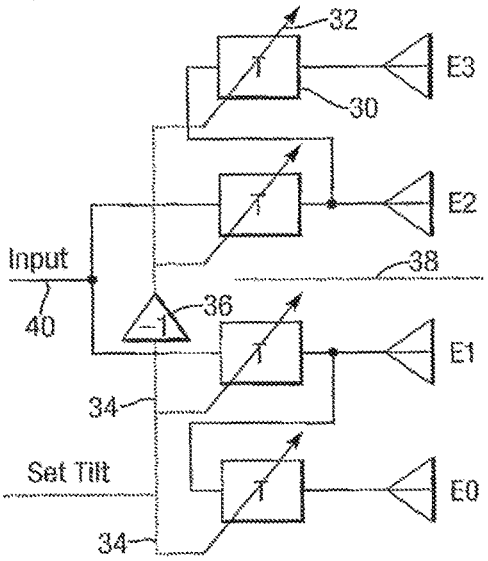
Fig.3(B) Prior art

FIG. 3(B) is FIG. 2(C) modified to introduce one stage of variable delay cascading between a lower pair of antenna elements E0 and E1 and another such stage between an upper pair of antenna elements E2 and E3, all delays being T. As has been said, amplifier symbol 36 indicates that lower antenna element delays increase when upper antenna element delays reduce and vice versa. FIG. 3(B) is a symmetrical 'daisy chain' corporate feed, but it has a total delay requirement of 4T.

Figure 3C:
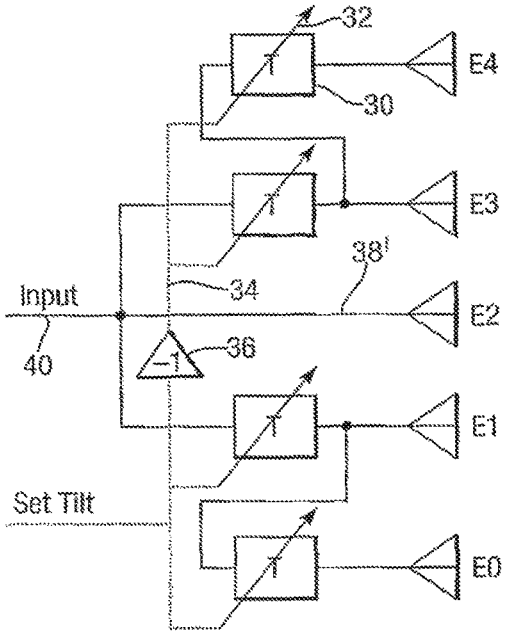
Fig.3(C) Prior art

FIG. 3(C) is FIG. 3(B) modified to introduce a fifth antenna element E2 centrally located and with undelayed input signal. It is an optimum implementation In the prior art provided that the use of (Ne−1) (equal) delays is acceptable, where Ne Is the number of elements: it can be used in a symmetrical corporate feed which allows practically realisable splitter ratios to be used.

All of the configurations shown in FIGS. 2(A) to 2(D) and 3(A) to 3(C) provide:

(a) a linear and equally spaced phase front along a line (array) of antenna elements to cause the antenna to tilt with an amplitude taper that does not vary, and (b) a corporate feed network with an amplitude taper across a line of antenna elements in order to suppress side lobes, increase antenna gain, and reduce interference outside of an antenna boresight region.

Consequently, any loss of directivity gain in these configurations is solely attributable to aperture reduction from tilt. However, they require undesirably large numbers of phase shifters and total delay requirements, which means that:

1. FIGS. 2(A), 2(B) and 2(C) are rarely used, except for specialised applications;
2. FIG. 2(D) finds use in antennas for cellular radio systems but has high cost, weight and size;
3. FIG. 3(A) has an asymmetric corporate feed and leads to impractical signal splitter ratios;
4. FIG. 3(B) has more time delay devices than are necessary to tilt an antenna correctly; and
5. FIG. 3(C) is a current optimum prior art implementation, but requires an undesirably large number of delays.

In situations where it is desirable for an antenna to be shared by multiple operators or users, all of the configurations in FIGS. 2(A) to (D) and 3(A) to (C) are even more unattractive: they have too many time delay devices to enable operators using different RF carrier frequencies to have individually adjustable angles of electrical tilt.

The number of time delays required for a phased array can be reduced by arranging antenna elements in sub-groups with delay changing between but not within sub-groups; however, this gives reduced performance by degrading the tilt range and antenna gain through spoiling of phase taper.

FIGS. 2(A) to (D) and 3(A) to (C) also illustrate the difficulty of implementing a phased array in terms of the numbers and delay range of the variable delays required. Location of the variable delays is a particular problem because of sheer bulk: in this regard, variable delays or phase shifters may be implemented electronically, but are most commonly implemented mechanically by varying lengths of transmission line through which signals pass to antenna elements: see e.g. U.S. Pat. No. 6,198,458 which discloses a mechanical variable delay or phase shifter. One may a) site variable delays with the antenna assembly: for a mast-mounted or gantry-mounted assembly the delays are high in the air at a mast head where they are not easily accessible for adjustment (see U.S. Pat. No. 6,067,054 to Johannisson et al. and U.S. Pat. No. 6,573,875 to Zimmerman at al.). One may alternatively b) site the delays remotely from the antennas in a base station: each antenna element requires a different signal delay and so one has to send many feeder cables up the mast from each phase shifter to each antenna. Multiplicity of feeder cables involves considerable expense, weight and phase errors (phase changes occur along feeders as the weather and even sunlight changes), and the electrical length of the feeders must be matched. It is a long-felt want to avoid both alternatives a) and b).

Techniques have been developed to use only one variable delay to implement electrical tilting of a phased array: see e.g. International Patent Application Nos. WO 03/036756, WO 03/043127, WO 2004/088790, WO 2004/102739 and WO 2005/048401. WO 2004/102739 in particular has an embodiment shown in FIG. 4 comprising a configuration of splitters S, 180 degree hybrid couplers H and fixed phase shifts −180 degrees, φ; this configuration forms combinations of signals with variable delay as appropriate for a phased array of antenna elements E1U, E1L etc. However, it is limited to a tilt variation range of 4.5 degrees for a 2 GHz phased array with twelve antenna elements spaced apart by 0.9 of a wavelength: this range is undesirably small for a number of phased array applications.

Figure 5:
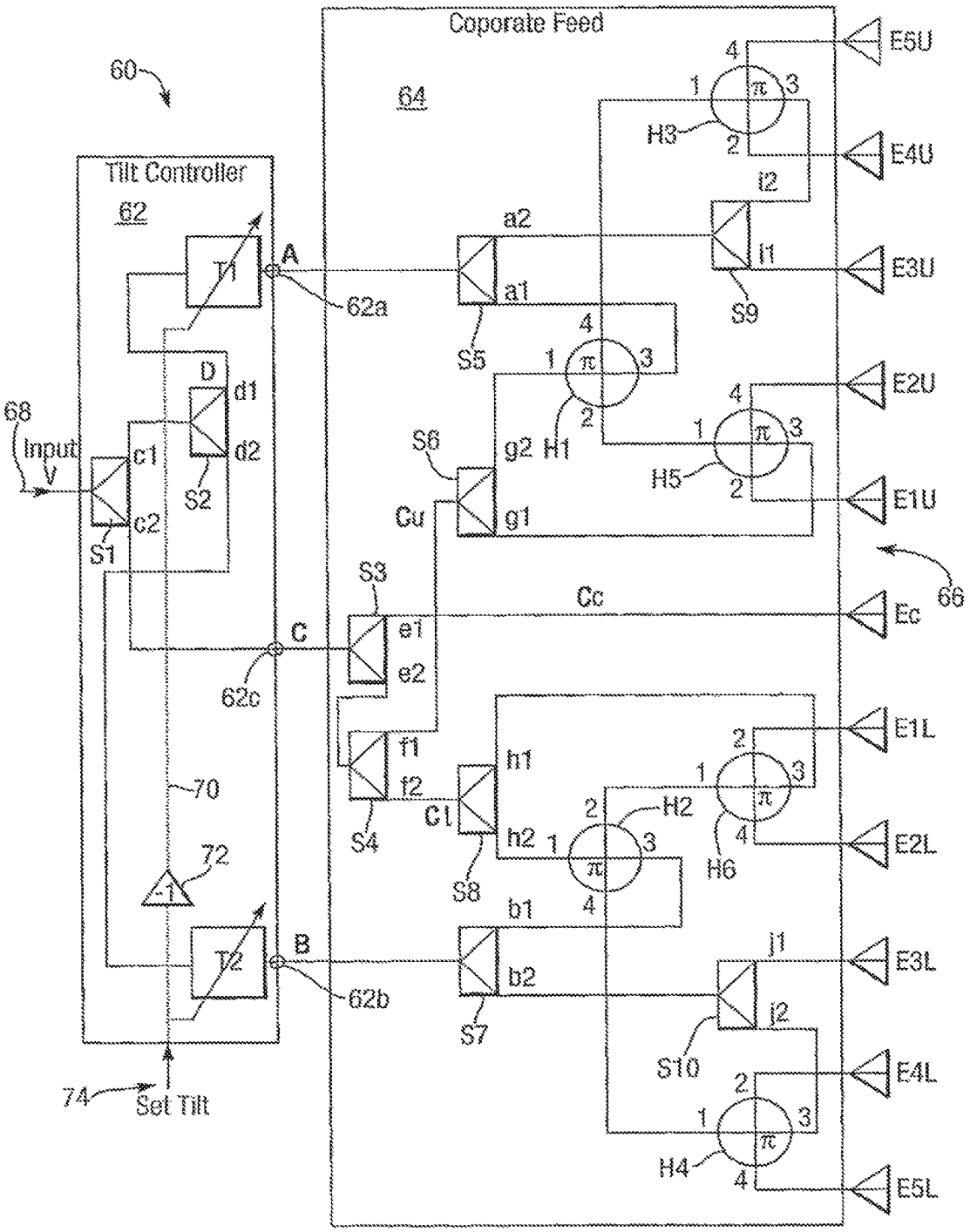
FIG. 5 is a schematic block diagram of a first embodiment of the invention using two variable time delay devices for adjusting the angle of electrical tilt of a phased array antenna.

Referring now to FIG. 5, an antenna system 60 of the invention is shown. The system 60 incorporates phase padding components (not shown) to equalize the phase shifts experienced by signals passing through it. This is known in the art and will not be described in detail (see e.g. WO 2004/102739): a signal route from an input to an antenna element incorporating hybrid couplers includes a phase shift of 180 degrees per coupler, so if the maximum number of couplers per signal route is n and the minimum is 0, a route including i couplers requires components for phase padding of 180(n-i) degrees.

The system 60 incorporates two main processing components, an electrical tilt controller 62 and a corporate feed 64, the latter connected to a phased array antenna 66. The antenna has eleven antenna elements, these being a central antenna element Ec, five antenna elements E1U to E5U disposed successively above it, and another five antenna elements E1L to E5L disposed successively below it.

An input signal represented as a vector V is applied to an input 68 of the tilt controller 62, in which it is split into two signal vectors c1.V and c2.V of differing amplitude by a first splitter S1 providing voltage split ratios c1 and c2. The signal vector c2.V is now designated as a tilt vector C, and appears at a controller output 62*c*.

The signal vector c1.V is further split by a second splitter S2 to provide first and second signal vectors c1.d1.V and c1.d2.V: the first signal vector c1.d1.V is delayed by a first variable delay T1 to give a signal vector which is now designated as a tilt vector A and appears at a controller output 62*a*; similarly, the second signal vector c1.d2.V is delayed by a second variable delay T2 to give a signal vector now designated as a tilt vector B and appealing at a controller output 62*b*. It is a feature of this embodiment of the invention that it uses only two variable delays T1 and T2 and three tilt vectors, later embodiments using more of each.

Tilt controller 62 consequently provides three antenna tilt control signals, these signals representing tilt vectors A=c1.d1.V[T1], B=c1.d2.V[T2] and C=c2.V, where [T1], [T2] indicate variable delay T1, T2 respectively. Delays T1 and T2 are ganged as denoted by a dotted line 70, which contains a −1 amplifier symbol 72 indicating that T1 increases from 0 to T when T2 reduces from T to 0 and vice versa: here T is a prearranged maximum value of delay for both of the ganged variable delays T1 and T2. Operation of a delay control 74 varies both of the ganged variable delays T1 and T2 in combination, and changes their respective delays by amounts which are equal in magnitude and opposite in sign (see symbol 72), one being an increase and the other a reduction: in response to these variable delay changes, the angle of electrical tilt of the antenna 66 also changes.

A third splitter S3 with voltage split ratios e1 and e2 splits tilt vector C into signals e1.C and e2.C, or equivalently c1.e1.V and c2.e1.V; signal e1.C is designated Cc (C central) and fed as a drive signal to the central antenna element Ec (an antenna element drive signal results in radiation of that signal from the associated antenna element into free space). Signal e2.C is further split by a fourth splitter S4 with voltage split ratios f1 and f2; this produces a signal c2.e2.f1.V designated Cu (C upper), and also a signal c2.e2.f2.V designated Cl (C lower). It is not essential that the signal Cc be not subject to delay in a variable or fixed delay device, but it is convenient to minimise circuitry and reduce design complexity and costs. Moreover, as described elsewhere herein, in practice the signal Cc is delayed or phase shifted by means not shown for phase padding purposes to compensate for delays introduced by components through which other signals pass.

The vectors A and Cu are used to provide drive signals to antenna elements E1U to E5L connected to the upper part of the corporate feed 64. Fifth and sixth splitters S5 and S6 with voltage split ratios a1, a2 and g1, g2 respectively split tilt vector A into signals a1.A and a2.A, and tilt vector Cu into signals g1.Cu and g2.Cu.

Similarly, the vectors B and Cl are used to provide drive signals to antenna elements E1L to E5L connected to the lower part of the corporate feed 64. Seventh and eighth splitters S7 and 38 with voltage split ratios b1, b2 and h1, h2 respectively split tilt vector B into signals b1.B and b2.B, and tilt vector Cl into signals h1.Cl and h2.Cl.

A ninth splitter S9 with voltage split ratios i1 and i2 splits signal a2.A from fifth splitter S5 into signals i1.a2.A and i2.a2.A, of which signal i1.a2.A is connected to and provides a drive signal for third upper antenna element E3U. A tenth splitter S10 with voltage split ratios j1 and j2 splits signal b2.B from seventh splitter S7 into signals j1.b2.B and j2.b2.B, of which signal j1.b2.B is connected to and provides a drive signal for third lower antenna element E3L.

The corporate feed 64 incorporates six vector combining devices H1 to H6, each of which is a 180 degree hybrid (sum and difference hybrid) having two input terminals designated 1 and 3 and two output terminals designated 2 and 4. Signals pass from each input to both outputs: a relative phase change of 180 degrees appears between signals passing between one input-output pair as compared to the other: as indicated by the location of a character π on each hybrid, this occurs between input 1 and output 4 in hybrids H1 and H2, and between input 3 and output 4 in hybrids H3 to H6. Each of the hybrids H1 to H6 produces two output signals which are the vector sum and difference of its input signals.

The first hybrid H1 receives input signals a1.A from fifth splitter S5 and g2.Cu from sixth splitter S6: it adds and subtracts these signals to provide their difference as input to the third hybrid H3 and their sum as input to the fifth hybrid H5. Similarly, the second hybrid H2 receives input signals b1.B from seventh splitter S7 and h2.Cl from eighth splitter S8: it provides these signals' difference as input to the fourth hybrid H4 and their sum as input to the sixth hybrid H6.

The third hybrid H3 receives another input signal i2.a2.A from ninth splitter S9 in addition to that from first hybrid H1, and produces sum and difference signals for output as drive signals to fourth and fifth upper antenna elements E4U and E5U respectively.

The fifth hybrid H5 receives another input signal g1.Cu from sixth splitter S6 in addition to that from first hybrid H1, and produces sum and difference signals for output as drive signals to first and second upper antenna elements E1U and E2U respectively.

The fourth hybrid H4 receives another input signal j2.b2.B from seventh splitter S7 in addition to that from second hybrid H2, and produces sum and difference signals for output as drive signals to fourth and fifth lower antenna elements E4L and E5L respectively.

The sixth hybrid H6 receives another input signal h1.Cl from eighth splitter S8 in addition to that from second hybrid H2, and produces sum and difference signals for output as drive signals to first and second lower antenna elements E1L and E2L respectively.

First, third and fifth hybrids H1, H3 and H5 implement vector combination processes to generate signals for antenna elements E1U, E2U, E4U and E5U, and second, fourth and sixth hybrids H2, H4 and H6 implement the like for antenna elements E1L, E2L, E4L and E5L. Signals for antenna elements Ec, E3U and E3L are generated by splitters without hybrids. The hybrids H1 to H6 are four port devices with two input ports 1 and 3, and two output ports 2 and 4; their input-output characteristics are described by s parameters, i.e. scattering parameters sxy (x=1 or 3, y=2 or 4) indicating the gain experienced by a signal passing between ports x and y. The scattering parameters of hybrid Hn (n=1 to 6) will be designated Hn.sxy.

A signal at input port 1 experiences a relative phase delay of π radians (as indicated by symbol π) on passing to output port 4, but this does not apply to signals passing between ports 1 and 2, 3 and 2 or 3 and 4. Signals appearing at output port 2 and output port 4 of hybrid H1 are given by:

$$H1 \text{ output port 2 signal}=H1(2)=a1.H1s23.A+g2.H1s21.Cu$$

$$H1 \text{ output port 4 signal}=H1(4)=a1.H1s43.A-g2.H1s41.Cu$$

Output port 2 and output port 4 of fifth hybrid H5 provide signal vectors for antenna elements E1U and E2U respectively as follows:

$$H5 \text{ output port 2 signal}=H5(2)=E1U \text{ signal}=H5s21.H1(2)+g1.H5s23.Cu$$

$$\text{i.e. } H5(2)=H5s21(a1.H1s23.A+g2.H1s21.Cu)+g1.H5s23.Cu$$

$$\text{and: } H5 \text{ output port 4 signal}=H5(4)=E2U \text{ signal}=H5s41.H1(2)-g1.H5s43.Cu$$

$$\text{i.e. } H5(4)=H5s41(a1.H1s23.A+g2.H1s21.Cu)-g1.H5s43.Cu$$

Splitter S9 provides a signal vector for antenna element E3U, $$\text{i.e. } E3U \text{ signal}=a2.i1.A$$

Output port 2 and output port 4 of third hybrid H3 provide signal vectors for antenna elements E4U and E5U respectively as follows:

Outputs (2) and output (4) of hybrid (M) generate the element vectors E4A and E4A:

$$H3 \text{ output port 2 signal}=H3(2)=E4U \text{ signal}=H1(4).H3s21+a2.i2.H3s23.A$$

$$\text{i.e. } E4U \text{ signal}=H3s21.(a1.H1s43.A-g2.H1s41.Cu)+a2.i2.H3s23.A$$

$$H3 \text{ output port 4 signal}=H3(4)=E5U \text{ signal}=H1(4).H3s21-a2.i2.H3s23.A$$

$$\text{i.e. } E5U \text{ signal}=H3s21.(a1.H1s43.A-g2.H1s41.Cu)-(a2.i2.H3s23.A)$$

Figure 6:
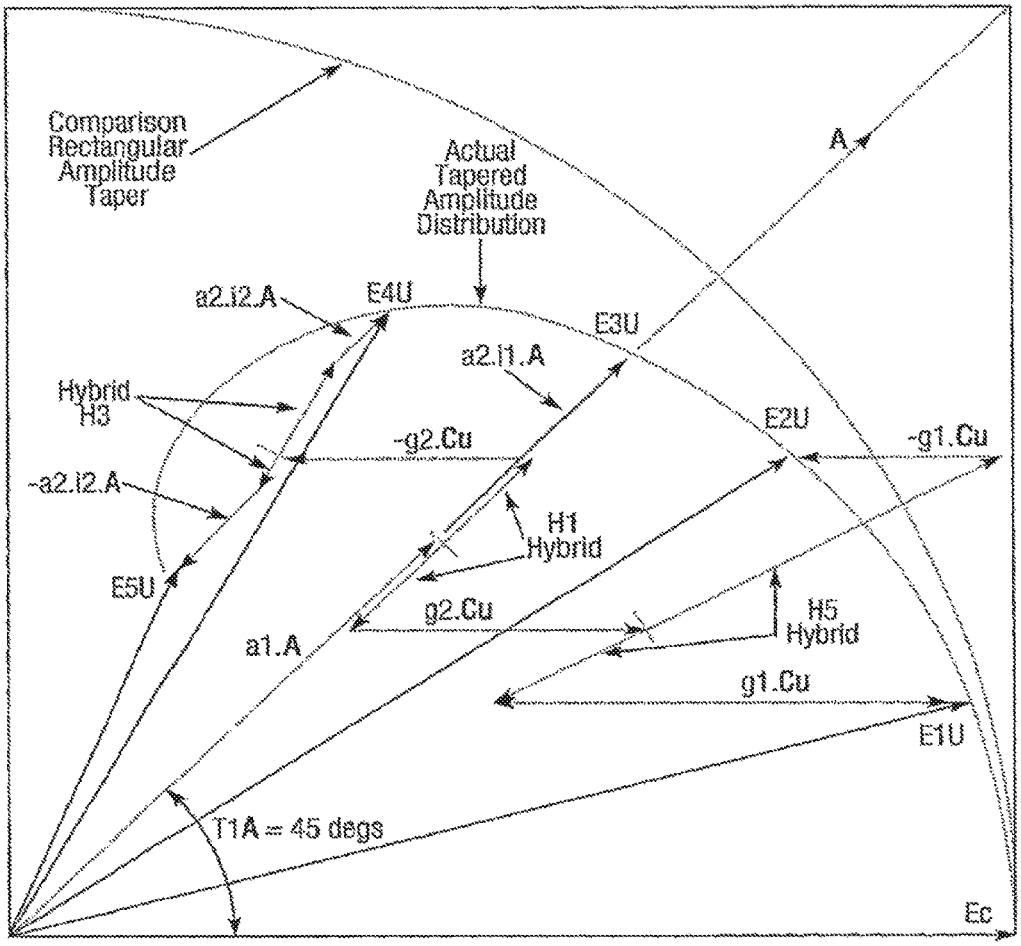
FIG. 6 is a vector diagram for the embodiment of FIG. 5.

FIG. 6 is a vector diagram of signal vectors for central and upper antenna elements Ec and E1U to E5U for the case when variable delay T1 provides a phase shift of +45 degrees. Scattering parameters are not shown to reduce complexity, and the drawing is not to scale: smaller vectors have been increased in size to improve visibility—actual magnitudes are indicated later by a table of scattering parameters. FIG. 6 shows that the signal vectors produced as described above for antenna elements E1L to E5L produce an amplitude taper which suppresses side lobes: these signal vectors also give rise to a substantially linear phase taper which tilts the beam of the antenna array 66 without compromising its beam shape, and hence gain, which would otherwise arise due to phase spoiling.

Expressions for signal vectors for lower antenna elements E1L to E5L will not be described: they are similar to those for upper antenna elements E1U to E5U with substitution of signal vector B for signal vector A, together with appropriate splitter ratios and hybrid scattering parameters of items in the lower half of the corporate feed 64. Pairs of correspondingly located antenna elements ExU and ExB (x=1 to 5) have like amplitudes but different phase angles due to the differential action of variable delays T1 and T2 (delay T2 provides a phase shift of −45 degrees equal and opposite to that of delay T1), and are in conformity with phased array requirements.

Phasing of signal vectors or drive signals for the antenna elements Ec, E1U to E5U and E1L to E5L relative to one another is imposed by the tilt controller 62 and the corporate feed 64 in combination. This relative phasing is prearranged by choice of splitting ratios and signals for vectorial combination in hybrids: it is appropriate for phased array beam steering by control of angle of electrical tilt, which varies in response to adjustment of the two variable delays T1 and T2.

TABLE 1

Splitter and Hybrid Parameters

| Splitter or Hybrid | Type | Parameter | Split Ratio or Scattering Parameter: Voltage Ratio | Decibels (dB) |
|---|---|---|---|---|
| S1 | DBQH | c1 | 0.7045 | −3.04 |
| | | c2 | 0.7097 | −2.98 |
| S2 | SDH | d1, d2 | 0.7071 | −3.01 |
| S3 | SDH | e1 | 0.6859 | −3.27 |
| | | e2 | 0.7277 | −2.76 |
| S4 | SDH | f1, f2 | 0.7071 | −3.01 |
| S5, S7 | DBQH | a1, b1 | 0.5559 | −5.10 |
| | | a2, b2 | 0.8313 | −1.61 |
| S6, S8 | DBQH | g1, h1 | 0.6636 | −3.56 |
| | | g2, h2 | 0.7481 | −2.52 |
| S9, S10 | DBQH | i1, j1 | 0.4421 | −7.09 |
| | | i2, j2 | 0.8970 | −0.94 |
| H1, H2 | SDH | s21, s43 | 0.7435 | −2.57 |
| | | s23, s41 | 0.6688 | −3.49 |
| H3, H4 | SDH | s21, s43 | 0.3162 | −10.00 |
| | | s23, s41 | 0.9487 | −0.46 |
| H5, H6 | SDH | s21, s43 | 0.3162 | −10.00 |
| | | s23, s41 | 0.9487 | −0.46 |

The splitters S1 to S9 and hybrids H1 to H6 provide voltage splitting ratios and input/output scattering parameters which are shown in Table 1, in which 'DBQH' means double box quadrature (90 degree) hybrid and 'SDH'=sum-and-difference (180 degree) hybrid.

Values for the parameters were derived from a computer simulation that calculated values for practically achievable splitter ratios while generating a desired amplitude taper for the antenna array 66. FIG. 5 and Table 1 apply to one polarisation of an antenna array: they may be replicated for use with each polarisation of a dual polarised antenna; i.e. a dual polarised antenna may incorporate two tilt controllers 62 and two corporate feeds 64.

Figure 4:
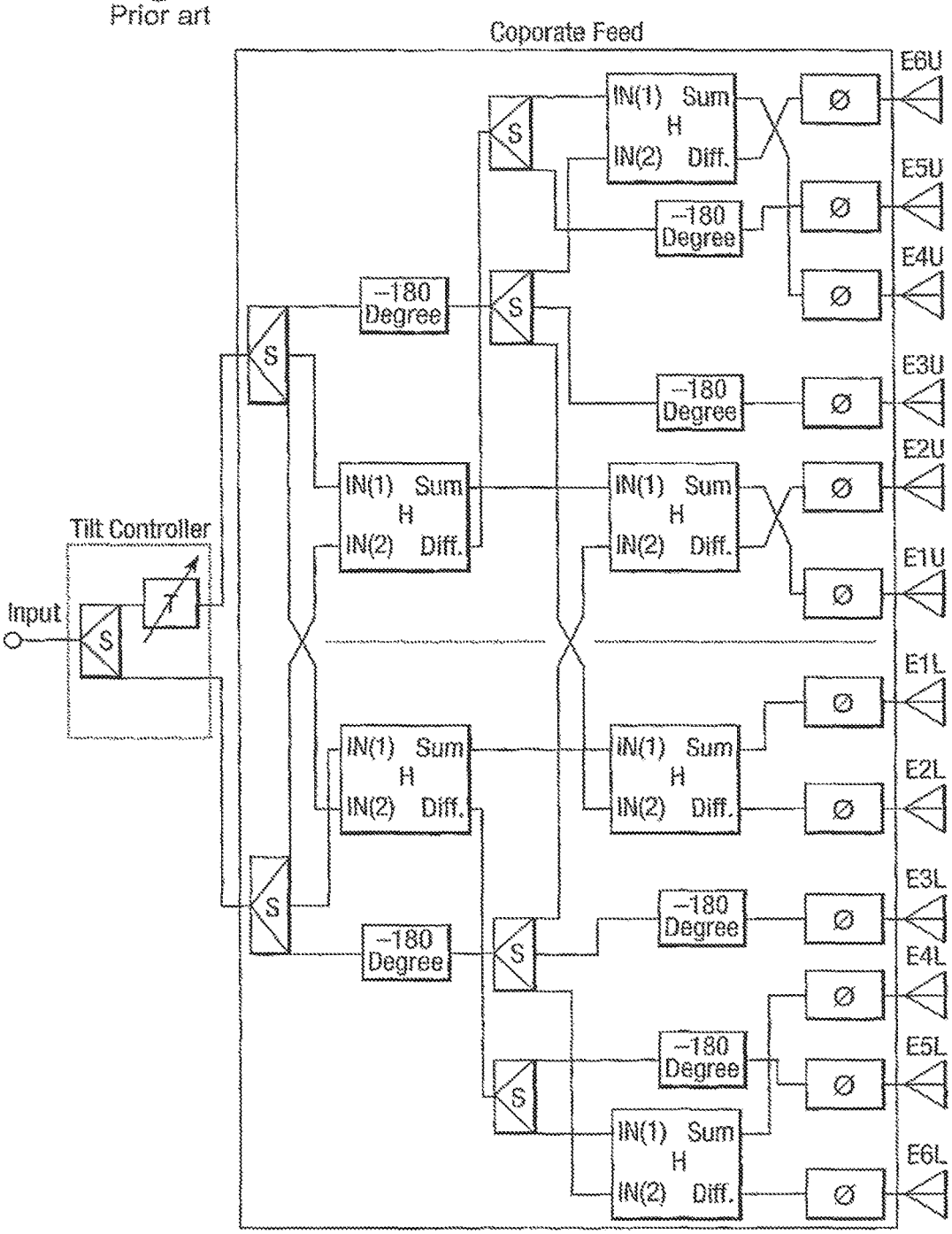
Fig.4. Prior art
FIG. 4 illustrates prior art use of a single time delay device for adjusting electrical tilt.

The antenna system 60 provides an increased tilt range of 6.5 degrees compared to 4 degrees for the prior art system shown in FIG. 4, 62.5% improvement, this being for a maximum side lobe level of −18 dB relative to boresight in each case. The antenna system 60 provides a tilt range of 10 degrees if its upper side lobe 20 can be allowed to increase to −15 dB.

Irrespective of its number of antenna elements, the bandwidth of an antenna system of the invention is maximised when the antenna system is implemented as a 'phase neutral' design in order to minimise frequency effects. Additional fixed delays are therefore added to ensure that differential track lengths do not cause frequency effects when the antenna system is operated at a frequency other than its centre frequency or design frequency. Additional fixed delays may also be incorporated between the output of the corporate feed 64 and the antenna elements Ec, E1U to E5U and E1L to E5L in order to insert a fixed tilt off-set since, in general, mobile telephone users are not located on the horizon. This additional delay may conveniently be inserted with lengths of cable.

The antenna system 60 of the invention shown FIG. 5 has a form of time delay symmetry about a central horizontal line through element Ec. An antenna element drive signal which passes to element Ec has a time delay which is treated as a reference in relation to time delays of drive signals which pass to other elements E1U to E5U and E1L to E5L respectively; i.e. the time delay of the drive signal to central element Ec remains constant while the time delays of drive signals to other elements E1U to E5U and E1L to E5L change in response to operation of the ganged variable delays T1 and T2. Moreover, the time delays of drive signals to upper elements E1U to E5U increase while those to lower elements E1L to E5L reduce and vice versa, and a radio signal radiated into free space from the elements in combination has a phase front which is substantially linear (as defined below) to a reasonable approximation: consequently drive signal time delay can be envisaged as a phase line pivoting about the central element Ec, the line indicating increase in magnitude of time delay with distance from Ec and change of sign of time delay at Ec (at which time delay is treated as a reference zero). The equation of such a line is d=nt, where d is element drive signal time delay, t is a variable time delay controlled by T12 and T2, and n is element number in EnU or EnL (i.e. n=1 to 5 and −1 to −5) indicating distance from Ec with opposite signs for elements in different (i.e. upper or lower) halves of the antenna array 66.

A radio signal radiated into free space from an antenna array will have a phase front which is linear across the array if there is a constant phase difference between signals at adjacent antenna elements. Such a phase front will be substantially linear across the array if the phase difference between signals at adjacent antenna elements does not vary by more than 10%.

It is possible to treat a drive signal to any element E1U to E5U, Ec or E1L to E5L as a reference zero of time delay; e.g. choosing a drive signal to lowermost end element E5L as a reference zero results in the envisageable phase line pivoting about the lower end of the antenna array 66 and drive signals to all other elements E1L to E4L, Ec and E1U to E5U having time delays which are all positive or all negative with respect to the lowermost end element drive signal. However, choice of the central element Ec as a reference zero of time delay avoids a practical problem over splitter ratios: as the chosen reference zero of time delay moves away from the central element Ec, the splitter ratios required to implement amplitude taper increase in value and become more difficult to obtain. For this reason it is preferred to use the central element Ec as a reference zero of time delay.

Figure 7:
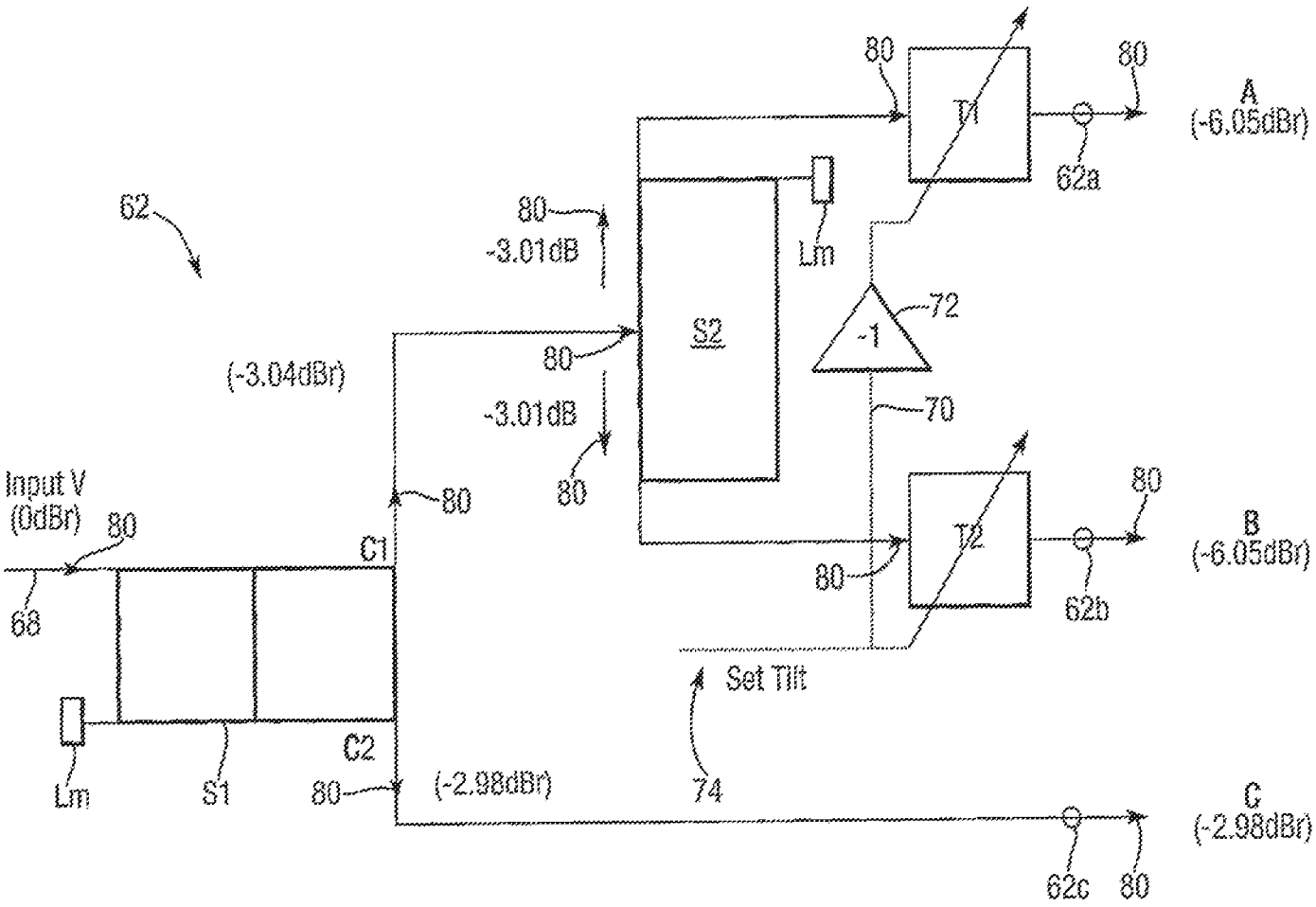
FIG. 7 shows a circuit layout for a tilt controller in the embodiment of FIG. 5.

Referring now to FIG. 7, the tilt controller 62 is shown in more detail: parts described earlier are like-referenced. Splitter S1 is implemented using a 'double box' quadrature hybrid having one (unused) port terminated in a matched load Lm and unequal output amplitudes c1 (−3.04 dBr) and c2 (−2.98 dBr), the latter becoming the tilt vector (C).

The decibel ratio dBr is the level of any point in the corporate feed with respect to a point of assigned reference level, which here is taken as the input port to the antenna corporate feed.

Output c1 is split into two equal amplitudes by splitter S2: splitter S2 is implemented as a sum-and-difference hybrid with an unused port terminated in a matched load Lm and outputs delayed by T1 and T2 to give tilt vectors A and B respectively with relative levels of −6.05 dBr. Arrows 80 pointing towards and away from hybrids and delays indicate inputs and outputs. The matched loads Lm do not give rise to power loss in transmit mode (ignoring effects due to non-ideal hybrids), because they are associated with input ports to which output power does not flow. They also do not give rise to power loss in receive made for a signal source located on the antenna boresight 18*a* or 18*b* in FIG. 1 (the antenna system 60 can be operated in reverse as a receiver as described later). They do however give rise to power loss in receive mode for an off-boresight signal source.

Figure 8:
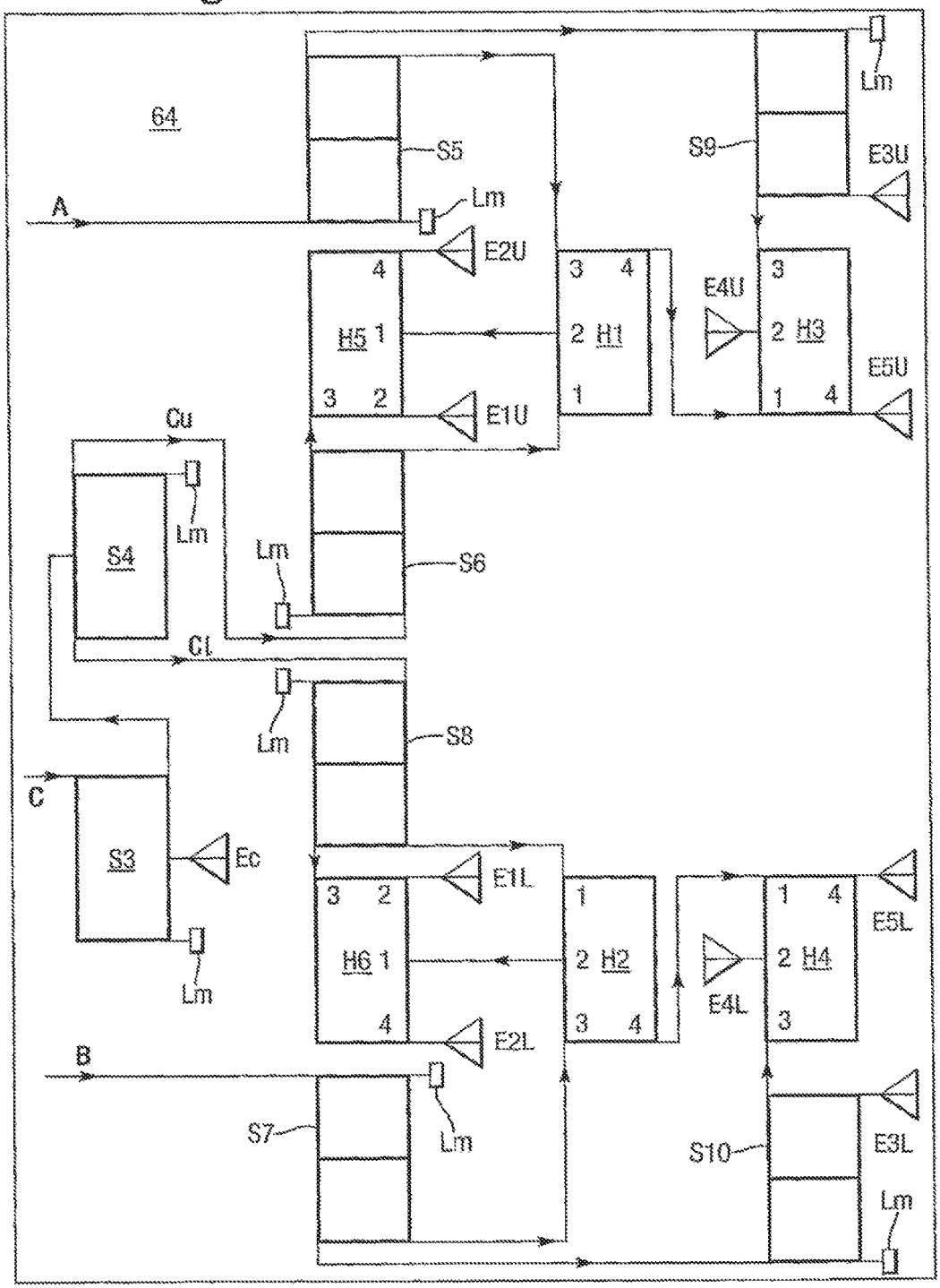
FIG. 8 shows a circuit layout for a corporate feed in the embodiment of FIG. 5.

FIG. 8 shows the corporate feed 64 in more detail: parts described earlier are like-referenced. Splitters S3 and S4 are implemented as sum-and-difference hybrids, splitters S5 to S10 as 'double box' quadrature hybrids, and the splitters S3 to S10 all have one unused port terminated in a matched load Lm. Hybrids H1 to H6 are implemented as sum-and-difference hybrids.

Figure 9:
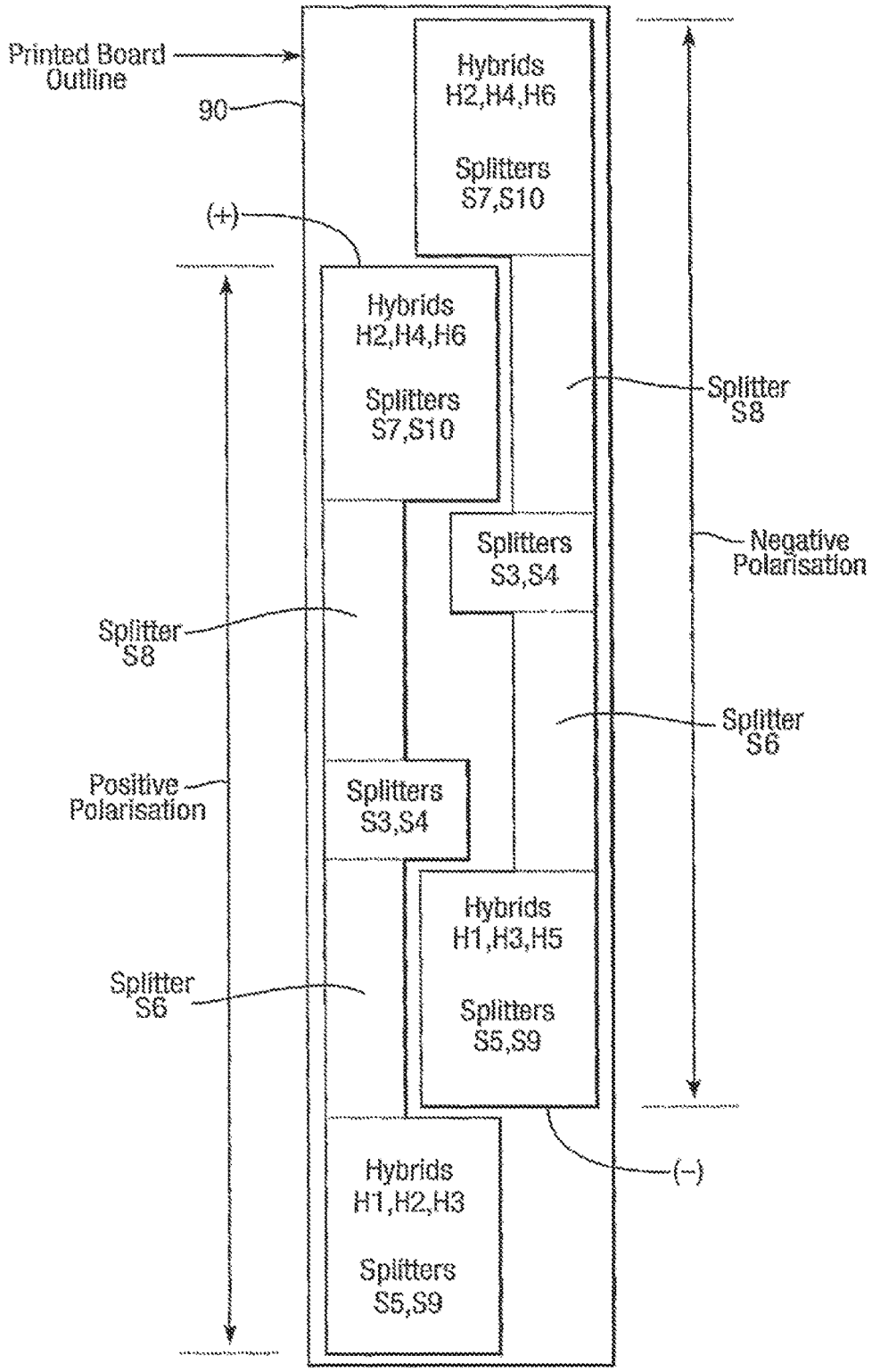
FIG. 9 is a schematic block diagram illustrating construction of the embodiment of FIG. 5 in a form suitable for two polarisations.

FIG. 9 shows schematically how a single printed circuit board 90 may support two corporate feeds 64(+) and 64(−) to implement positive and negative polarisations of a dual polarised antenna respectively: parts described earlier are like-referenced. Groups of splitters S3 to S10 and hybrids H1 to H6 are indicated by boxes indicating layout.

Each corporate feed 64(+) or 64(−) is laid out generally as an E shape and is arranged in complementary or interlocking fashion with respect to the other.

Each corporate feed 64(+) or 64(−) is associated with a respective tilt controller 62 (not shown). One or more tilt controllers 62 may be mounted either with a corporate feed or corporate feeds 64 within an antenna radome (not shown), or separately from corporate feed(s) remote from the radome. In either case the tilt vectors A, B and C pass between the tilt controller 62 and its associated corporate feed 64 via connections which preserve the phase relationship between these vectors. Alternatively, if this is not the case, the tilt controller 62 or corporate feed 64 must include compensation for any phase error departure introduced by these connections.

An antenna assembly in accordance with FIG. 9 can be implemented within size constraints imposed by a typical radome of a phased array antenna; moreover, it transpires that leads emerging from the corporate feeds 64(+) and 64(−) are distributed in a manner which advantageously is substantially as required for connection to antenna elements E1U to E5U, Ec and E1L to E5L disposed in a conventional manner. This results in the total length of cable to connect from the corporate feed 64 to the antenna elements being reduced giving reduced losses.

Figure 10:
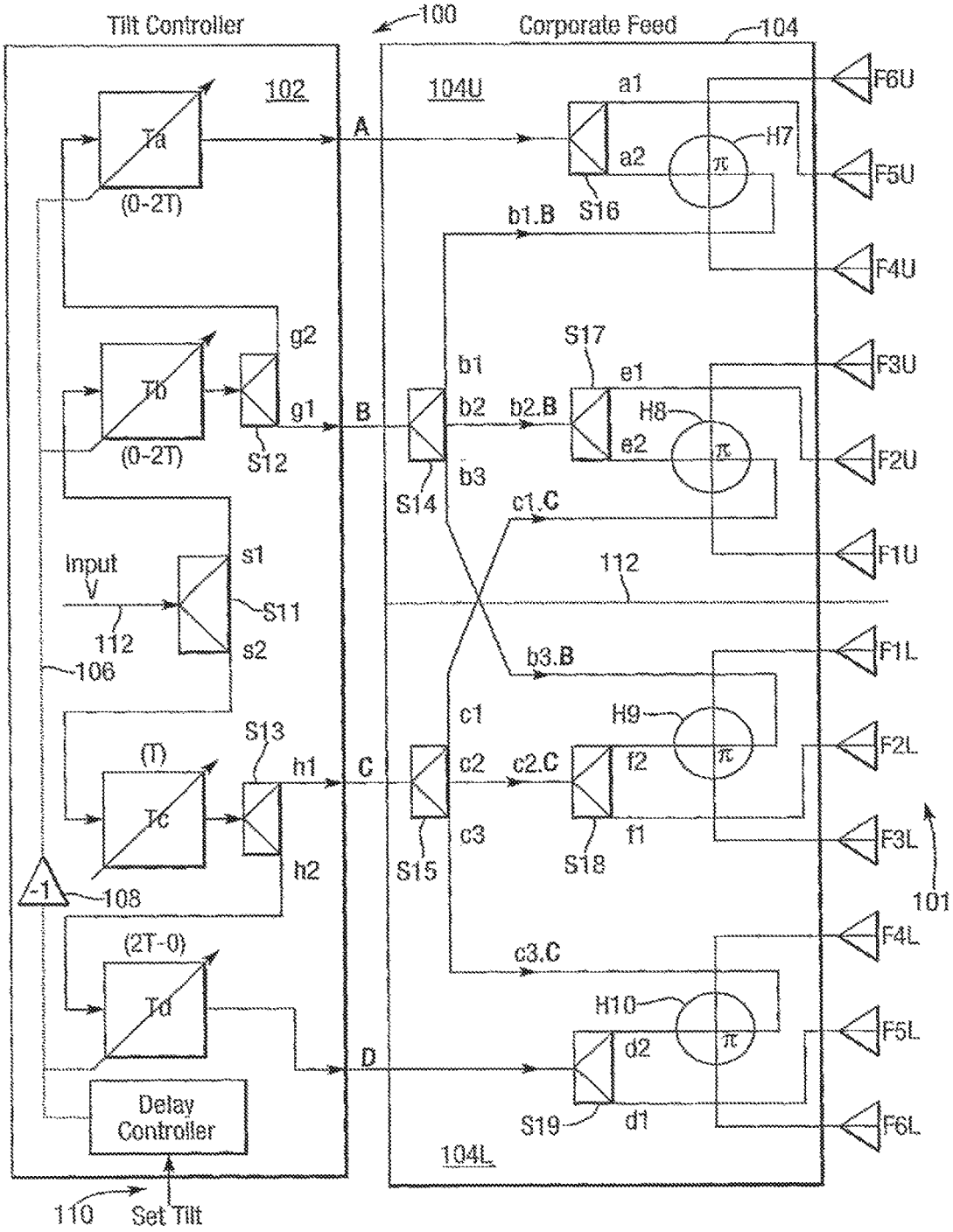
FIG. 10 is a schematic block diagram of a second embodiment of the invention using three variable time delay devices.

Referring now to FIG. 10, a further antenna system 100 of the Invention has an antenna array 101 with twelve antenna elements F1U to F6U and F1L to F6L: it employs first, second and third variable delays Ta, Tb and Td and one fixed delay Tc, which are located in a tilt controller 102 connected to a corporate feed 104. First and second variable delays Ta and Tb each provide delay variable from 0 to 2T, third variable delay Td provides delay variable from 2T to 0, and the fixed delay Tc provides delay of T. Phase padding components (not shown) are located in the corporate feed 104 to equalize the phase shifts experienced by signals passing to the antenna elements F1U to F6U and F1L to F6L.

The first, second and third variable delays Ta, Tb and Td are ganged as denoted by a dotted line 106, which contains a −1 amplifier symbol 108 indicating that first and second variable delays Ta and Tb increase when third variable delay Td reduces and vice versa: variation of these ganged delays changes antenna electrical tilt in response to a Set Tilt control 110.

An input signal vector V at 112 is split into two signals s1.V and s2.V by a first splitter S11. The signal s1.V is delayed by second variable delay Tb and then split by a second splitter 812 into two signals g1.s1V and g2.s1.V, of which signal g1.s1.V is designated tilt vector B. Signal g2.s1.V is further delayed by first variable delay Ta and is then designated tilt vector A.

Signal s2.V from first splitter S11 is delayed by the fixed delay Tc and then split by a third splitter S13 into two signals h1.s2.V and h2.s2.V, of which signal h1.s2.V is designated tilt vector C. Signal h2.s2.V is further delayed by third variable delay Td and is then designated tilt vector D.

Hence the tilt vectors are given by:

$$A=g2.s1.V[Ta+Tb],$$

$$B=g1.s1.V[Tb],$$

$$C=1.s2.V[Tc],$$

$$D=h2.s2.V[Tb+Td].$$

where [ . . . ] means delayed by the contents of the square brackets as before.

The corporate feed 104 is symmetrical about a horizontal centre line 112 shown dotted; i.e. it has an upper half 104U associated with antenna elements F1U to F6U and a lower half 104L associated with antenna elements F1L to F6L which is a mirror image of the upper half. The tilt vectors A and B are connected to the upper half 104U which generates voltages or signal vectors for upper antenna elements F1U to F6U. The tilt vectors C and D are connected to the lower half 104L which generates voltages or signal vectors for lower antenna elements F1L to F6L.

The corporate feed 104 splits tilt vectors A, B, C and D and forms signal vectors proportional to A and D, and combinations of proportions of B with A and C and C with B and D: this is carried out using splitters S14 to S19 and hybrids H7 to H10—it is similar to signal vector production described with reference to FIG. 5 and will not be described further.

Figure 11:
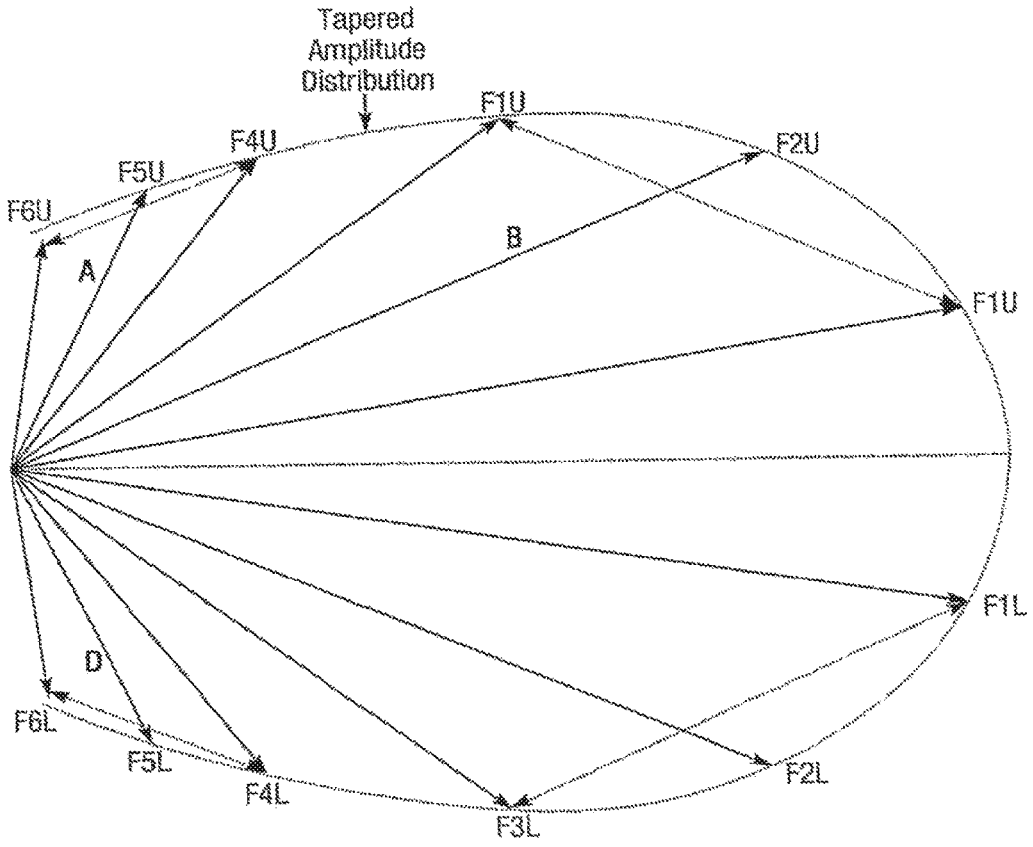
FIG. 11 is a vector diagram for the embodiment of FIG. 10.

FIG. 11 is a vector diagram of antenna element drive signals or vectors produced by the corporate feed 104. The signal vectors produce an amplitude taper suppressing antenna side lobes and a substantially linear phase taper: these tilt the antenna array beam 16 without compromising its beam shape, and hence gain, due to phase spoiling.

Signal vectors or voltages for antenna elements F1U to F6U and F1L to F6L are given by:

$$F6U=a2.A-b1.B$$

$$F5U=a1.A$$

$$F4U=a2.A+b1.B$$

$$F3U=b2.e2.B-c1.C$$

$$F2U=b2.e1.B$$

$$F1U=b2.e2.B+c1.C$$

$$F1L=c2.f2.C-b3.B$$

$$F2L=c2.f1.C$$

$$F3L=c2.f2.C+b3.B$$

$$F4L=d2.D-c3.C$$

$$F5L=d1.D$$

$$F6L=d2.D+c3.C$$

Referring now to FIG. 12, a further embodiment of an antenna system 120 of the invention incorporates an antenna array 121 and a tilt controller 122 connected to a corporate feed 124. The antenna array 121 has thirteen antenna elements, a central element Gc, six upper elements G1U to G6U and six lower elements G1L to G6L: it employs four variable delays, i.e. first, second, third and fourth variable delays TA, TB, TC and TD: these delays are located in the tilt controller 122, and provide equal maximum values of delay. The system 120 incorporates phase padding components (not shown) to equalize the phase shift experienced by signals passing from an input 126 via different routes to the antenna elements Gc, G1U to G6U and G1L to G6L.

The first, second, third and fourth variable delays TA, TB, TD and TE are ganged as denoted by a dotted line 128, which contains a −1 amplifier symbol 130 indicating that first and second variable delays TA and TB increase when third and fourth variable delays TD and TE reduce and vice versa: variation of these ganged delays changes antenna electrical tilt in response to a Set Tilt control 132.

A splitter Sv splits an input signal vector V into three signals, one of which is designated tilt vector C. The other two signals are fed respectively to second and third variable delays TB and TD: outputs from these delays are each split into two signals once more to provide signals designated tilt vectors B and D, together with signals for input to respective adjacent first and fourth variable delays TA and TE, which in turn provide signals designated tilt vectors A and E. Tilt vectors A and E therefore pass via two variable delays, tilt vectors B and D via one variable delay, and tilt vector C via none. Tilt vector C is there not delayed in the tilt controller 122; tilt vectors A and E undergo twice the delay of tilt vectors B and D respectively, and tilt vectors A and B increase in delay when tilt vectors D and E reduce in delay and vice versa.

The corporate feed 124 has two-way and three-way splitters Sa to Se and four sum and difference hybrids Hab, Hbc, Hcd and Hde: these splitters and hybrids perform splitting, addition and subtraction operations on the tilt vectors A to E generate antenna element drive signals with signal phase varying across the array 121 of the antenna elements Gc, G1U to G6U and G1L to G6L as appropriate for phased array beam steering. This is similar to the mode of operation described for earlier embodiments 60 and 100, and will be discussed briefly only.

The central antenna element Gc receives a signal which has passed to it from the input 126 via two three-way splitters Sv and Sc, but no variable delays or hybrids. Two (upper and lower) antenna elements G2U and G2L receive respective signals which have passed via one variable delay TB or TD and one three-way splitter Sb or Sd, but no hybrids. Two further (upper and lower) antenna elements G5U and G5L receive respective signals which have passed via two variable delays TA, TB or TD, TE and one two-way splitter Sa or Se, but no hybrids. Eight other (upper and lower) antenna elements G2U and G2L receive respective signals generated by hybrids Hab, Hbc, Hod and Hde by addition and subtraction operations on all five tilt vectors A to E after splitting at splitters Sa to Se respectively, i.e. antenna elements G1U, G3U, G4U, G6U, G1L, G3L, G4L and G6L: of these, antenna elements G4U, G6U, G4L and G6L receive signals each of which is a combination (sum or difference) of two signals which have undergone one variable delay at TB or TD (fraction of tilt vector B or D) and two variable delays at TA and TB or TD and TE respectively (fraction of tilt vector A or E); antenna elements G1U, G3U, G1L and G3L receive signals each of which is a combination of a fraction of singly delayed tilt vector B or D with a fraction of undelayed tilt vector C.

FIGS. 13A and 13B provide vectorial illustrations of vector production to derive antenna element drive signals. It is for an antenna system (not illustrated) having an antenna array with nineteen antenna elements, a central element, nine upper elements and nine lower elements. This is equivalent to the antenna system 120 with the addition of two further variable delays (i.e. total six) and additional splitters and hybrids providing seven tilt 10 vectors with delays 3T, 2T, T, 0, −T, −2T and −3T (T variable) and six additional antenna element drive signals.

Vector diagrams 13A and 13B show horizontal bold radial arrows 132A and 132B indicating phase and amplitude of the same horizontal undelayed tilt vector in both drawings, the vector being that of a drive signal to a central antenna element (equivalent to element Ec in FIG. 12). Six other bold radial arrows 134A to 138A and 134B to 138B indicate phase and amplitude of six delayed tilt vectors, i.e. three such vectors in each drawing indicating drive signals to three upper and three lower antenna elements respectively. Twelve other radial arrows 140A to 150A and 140B to 150B indicate phase and amplitude of six other tilt vectors in each drawing obtained by processing in hybrids as sums and differences of tilt vectors. Three arcuate curved arrows 152A, 152B in each drawing indicate delays or phase shifts introduced by variable delays respectively.

Dotted curves 154A and 154B through the ends of signal vector arrows 132A to 150A, 132B to 150B indicate amplitude taper (change in amplitude between antenna elements to obtain desired beam shape). In the antenna system 120 described with reference to FIG. 12 to which FIGS. 13A and 13B relate, the signal vector for any antenna element only involves either one tilt vector or two tilt vectors that are adjacent in position in the circuit illustrated; consequently, in construction of corporate feed 124, it is possible to reduce circuit track lengths and avoid circuit track cross-overs. The antenna system 120 in particular may be designed to achieve a tilt range of 10 degrees for a maximum side lobe level of −18 dB. A vector diagram for the antenna system 120 may be obtained by deleting vectors 138A, 148A, 150A, 152A, 138B, 148B, 150B and 152B in FIGS. 13A and 13B.

The principles of the invention will now be discussed with reference to FIG. 14, which shows a generalised block diagram of an antenna system 200 of the invention with an RF port 202 connected to a tilt controller 204, itself connected via a corporate feed 206 to an antenna array 208.

Embodiments of the invention mentioned earlier have been described as operating in transmit mode with an input signal vector V being subject to splitting, delays and recombination to generate antenna element drive signals for transmission of radiation into free space. The antenna system 200 and other embodiments of the invention may be operated in transmit or receive mode. In transmit mode, the RF port 202 is an input port for input of a signal V to the tilt controller 204. In receive mode, the RF port 202 is an output port for output of a signal V from the tilt controller 204 corresponding to reception of a signal by the antenna array 208 from free space at a particular angle of tilt prescribed by variable delay settings in the tilt controller 204 (similarly to earlier embodiments). The tilt controller has a second input 210 that sets an angle of tilt for the antenna array 208.

In transmit mode, the tilt controller 204 outputs consist of a set of tilt vectors (A, B, C, D, etc.) as indicated below an arrow 212: an arrow 214 is shown dotted to indicate that the invention may generate as many tilt vectors as required. The tilt vectors A, B, etc. are connected to the corporate feed 206, which generates antenna element drive signal vectors as fractions of individual tilt vector or vector combinations of tilt vectors as described for earlier embodiments of the invention.

Vector combinations may be formed from a single level of vector addition, or from two or more levels of vector addition. A vector sum is an interpolation of vectors, while vector differences are extrapolations of vectors. Thus for a single level of vector addition and two tilt vectors A and B, extrapolated element vectors are formed from a vector difference D1:

$$D_1=a_1\cdot A-\sqrt{(1-(a_1)^2)}.B \qquad \text{Equation 1}$$

and interpolated element vectors are formed from a vector sum S1:

$$S_1=\sqrt{(1-(a_1)^2)}A+a_1.B \qquad \text{Equation 2}$$

A corporate feed using two levels of vector addition using $S_1$ in Equation 2 for example may generate a further extrapolated vector from a second level vector difference:

$$D_2=a_2\cdot A-\sqrt{(1-(a_2)^2)}S_1 \qquad \text{Equation 3}$$

and a further interpolated vector from a vector sum:

$$S_2=\sqrt{(1-(a_2)^2)}.A+a_2\cdot S_1 \qquad \text{Equation 4}$$

The invention employs at least three tilt vectors, e.g. tilt vectors A, B and C in FIG. 5. If N tilt vectors are used, this requires (N−1) variable delays (e.g. two variable delays for three tilt vectors) since one of the tilt vectors can be treated as a time reference for the other (N−1) tilt vectors.

Table 2 shows corporate feed topologies that are convenient to implement for embodiments employing three tilt vectors A, B and C, two variable delays and a single level of vector addition, such as that described with reference to FIG. 5.

Each antenna element drive signal or vector that is derived directly from a single tilt vector remains constant in amplitude, and has the phase shift introduced by the variable delay through which it passes (if any) or the phase of the input signal V if it does not pass through a variable delay. This ignores signal delays in components (e.g. hybrids) other than variable delays. The overall phase and amplitude accuracy for a phased array antenna with a non-zero angle of electrical tilt is a maximum when each tilt vector applied directly to a respective antenna element, and combinations of tilt vectors are applied to other antenna elements, as In the embodiments described above. A consequence of this is that preferred embodiments of antenna systems of the invention have 7, 11, 15 or 19 antenna elements.

An antenna system of the invention antenna may be implemented with a single level of vector addition. If so, however, splitter and hybrid ratios may exceed 10 dB, which presents implementation difficulties for circuit board design (impractically narrow tracks). This may occur, for example, for devices feeding outermost antenna elements (e.g. F6U, F6L in FIG. 10), where relatively low antenna signal amplitudes are required to implement amplitude taper for side lobe suppression purposes. It may therefore be preferable to employ two levels of vector addition to constrain splitter and hybrid parameters to less than 10 dB.

TABLE 2

| Number Of Antenna Elements (Ne) | Extra-polators of A and C | Tilt Vector A | Inter-polators of A and C | Centre Tilt Vector C | Inter-polators of B and C | Tilt Vector B | Extra-polators of B and C |
|---|---|---|---|---|---|---|---|
| 3 | 0 | 1 | 0 | 1 | 0 | 1 | 0 |
| 4 | 1 | 0 | 1 | 0 | 1 | 0 | 1 |
| 5 | 1 | 0 | 1 | 1 | 1 | 0 | 1 |
| 6 | 1 | 1 | 1 | 0 | 1 | 1 | 1 |
| 7 | 1 | 1 | 1 | 1 | 1 | 1 | 1 |
| 8 | 2 | 0 | 2 | 0 | 2 | 0 | 2 |
| 9 | 2 | 0 | 2 | 1 | 2 | 0 | 2 |
| 10 | 2 | 1 | 2 | 0 | 2 | 1 | 2 |
| 11 | 2 | 1 | 2 | 1 | 2 | 1 | 2 |
| 12 | 3 | 0 | 3 | 0 | 3 | 0 | 3 |
| 13 | 3 | 0 | 3 | 1 | 3 | 0 | 3 |
| 14 | 3 | 1 | 3 | 0 | 3 | 1 | 3 |
| 15 | 3 | 1 | 3 | 1 | 3 | 1 | 3 |
| 16 | 4 | 0 | 4 | 0 | 4 | 0 | 4 |
| 17 | 4 | 0 | 4 | 1 | 4 | 0 | 4 |
| 18 | 4 | 1 | 4 | 0 | 4 | 1 | 4 |
| 19 | 4 | 1 | 4 | 1 | 4 | 1 | 4 |

TABLE 3

| Number of Antenna Elements (Ne) | Extra-polators of A and C | Tilt Vector A | Inter-polators of A and C | Centre Tilt Vector C | Inter-polators of B and C | Tilt Vector B | Extra-polators of B and C |
|---|---|---|---|---|---|---|---|
| 12 | 3 | 1 | 2 | 0 | 2 | 1 | 3 |
| 13 | 3 | 1 | 2 | 1 | 2 | 1 | 3a |
| 16 | 4 | 1 | 3 | 0 | 3 | 1 | 4 |
| 16 | 6 | 0 | 2 | 0 | 2 | 0 | 6 |
| 17 | 4 | 1 | 3 | 1 | 3 | 1 | 4 |
| 17 | 6 | 0 | 2 | 1 | 2 | 0 | 6 |

Table 3 shows convenient antenna topologies for three tilt vectors, two time delay devices and two levels of vector addition.

Similar structures to those indicated by quantities in Table 1 and Table 2 may be derived for antenna systems which use more than three tilt vectors. With an input vector V, tilt vectors A, B, C, D (etc.) may be defined as:

$$A=\alpha_a V(\text{angle}(G_a\varphi)) \quad \text{Equation 5}$$

$$B=\alpha_b V(\text{angle}(G_b\varphi)) \quad \text{Equation 6}$$

$$C=\alpha_c V(\text{angle}(G_c\varphi)) \quad \text{Equation 7}$$

$$D=\alpha_d V(\text{angle}(G_d\varphi)) \quad \text{Equation 8}$$

$$D=\alpha_d V(\text{angle}(G_d\varphi))$$

Where $\varphi$ is an input angle set by the tilt controller 204, and $\alpha_X$ and $(G_X\varphi)$ are the amplitude and phase angle respectively of tilt vector X, where X is A, B, C or D.

$G_X$ is the gearing ratio between the phase of X and the input angle $\varphi$. The phase of X changes $G_X$ times as fast as $\varphi$.

Vector addition generates signals with a substantially flat phase front which can be shown as follows. Consider a first Lemma:

$$F(A, B) = g\sin(A + B) + h\sin(A - B) \quad \text{Equation 9}$$

$$F(A, B) = g\sin A\cos B + g\cos A\sin B + h\sin A\cos B - h\cos A\sin B \quad \text{Equation 10}$$

$$F(A, B) = (g + h)\sin A\cos B + (g - h)\cos A\sin B \quad \text{Equation 11}$$

$$F(A, B) = [\{(g + h)\cos B\}^2 + \{(g - h)\sin B\}^2]^{\frac{1}{2}} \sin\left[A + \tan^{-1}\left\{\left(\frac{g - h}{g + h}\right)\frac{\sin B}{\cos B}\right\}\right] \quad \text{Equation 12}$$

$$F(A, B) = (g^2 + h^2 + 2gh(\cos^2 B - \sin^2 B))^{\frac{1}{2}} \sin\left[A + \tan^{-1}\left\{\left(\frac{g - h}{g + h}\right)\frac{\sin B}{\cos B}\right\}\right] \quad \text{Equation 13}$$

$$F(A, B) = (g^2 + h^2 + 2gh\cos 2B)^{\frac{1}{2}} \sin\left[A + \tan^{-1}\left\{\left(\frac{g - h}{g + h}\right)\tan B\right\}\right] \quad \text{Equation 14}$$

Consider also a second Lemma giving an approximation for small $\theta$:

$$\cos\theta \approx 1,\ \tan\theta \approx \theta,\ n\tan\theta \approx \tan(n\theta) \approx n\theta \quad \text{Equation 15}$$

If the tilt controller 204 generates two neighbouring tilt vectors M and N having amplitudes Vm and Vn respectively, then:

$$\text{Putting}'\ \phi_{mn} = \frac{(G_m + G_n)\varphi}{2} \text{ and } G_m - G_n = 1$$

$$V_M = V_m\sin\left(\omega t + \phi_{mn} + \frac{\varphi}{2}\right) = \alpha_m V\sin\left(\omega t + \phi_{mn} + \frac{\varphi}{2}\right) \quad \text{Equation 16}$$

$$V_N = V_n\sin\left(\omega t + \phi_{mn} - \frac{\varphi}{2}\right) = \alpha_n V\sin\left(\omega t + \phi_{mn} - \frac{\varphi}{2}\right) \quad \text{Equation 17}$$

where: $V_m$, $V_n$ are determined by the splitter ratios $\alpha_m$, $\alpha_n$ and the input voltage V, $\varphi$ is the phase difference between $V_m$ and $V_n$, and $\varphi_{mn}$ is the phase difference between the phase centre of $V_m$ and $V_n$ and the input voltage V.

The vector algebra operating on outputs M and N generates a voltage at an ith antenna element (i) which is a vector sum of the voltages at m and n.

$$V_i = \gamma_i M + \kappa_i N \quad \text{Equation 18}$$

$$V_i = \gamma_i\alpha_m V\sin\left(\omega t + \phi_{mn} + \frac{\varphi}{2}\right) + \kappa_i\alpha n V\sin\left(\omega t + \phi_{mn} - \frac{\varphi}{2}\right) \quad \text{Equation 19}$$

From Lemma 1 this is:

$$= ((\gamma_i\alpha_m)^2 + (\kappa_i\alpha_n)^2 + 2\gamma_i\alpha_m\kappa_i\alpha_n\cos\varphi)^{\frac{1}{2}} \sin\left(\omega t + \phi_{mn} + \tan^{-1}\left(\left(\frac{\gamma_i\alpha_m - \kappa_i\alpha_n}{\gamma_i\alpha_m + \kappa_i\beta_n}\right)\tan\frac{\varphi}{2}\right)\right) \quad \text{Equation 20}$$

By suitable coupling of variable delays (not shown) in the tilt controller 204 and an offset for a common phase (phase of input signal V) it can be arranged that $$\phi_m = G_m\varphi \quad \text{Equation 21}$$

$$\phi_n = G_n\varphi$$

$$G_m - G_n = 1$$

$$\phi_{mn} = G_{mn}\varphi = \frac{(G_m + G_n)\varphi}{2}$$

where $G_j$ is a gearing ratio G, as in Equations 5 to 8, of signal j (j=m or n) phase relative to input $\varphi$.

And hence:

$$V_i = ((\gamma_i\alpha_m)^2 + (\kappa_i\alpha_n)^2 + 2\gamma_i\alpha_m\kappa_i\alpha_n\cos\varphi)^{\frac{1}{2}} \sin\left(\omega t + G_{mn}\varphi + \tan^{-1}\left(\left(\frac{\gamma_i\alpha_m - \kappa_i\alpha_n}{\gamma_j\alpha_m + \kappa_i\alpha_n}\right)\tan\frac{\varphi}{2}\right)\right) \quad \text{Equation 22}$$

Using the second Lemma:

$$V_i = ((\gamma_i\alpha_m)^2 + (\kappa_i\alpha_n)^2 + 2\gamma_i\alpha_m\kappa_i\alpha_n\cos\varphi)^{\frac{1}{2}} \sin\left(\omega t + G_{mn}\varphi + \frac{\gamma_i\alpha_m - \kappa_i\alpha_n\varphi}{\gamma_i\alpha_m + \kappa_i\alpha_n 2}\right). \quad \text{Equation 23}$$

The phase on element i driven by a vector sum of two adjacent tilt vectors M and N with an φ relative to the input signal is thus approximately:

$$Phase_i = G_{mn}\varphi + \frac{1}{2}\frac{\gamma_i\alpha_m - \kappa_i\alpha_n}{\gamma_j\alpha_m + \kappa_i\alpha_n}\varphi = \left(G_m + G_n + \frac{\gamma_i\alpha_m - \kappa_i\alpha_n}{\gamma_j\alpha_m + \kappa_i\alpha_n}\right)\frac{\varphi}{2} \quad \text{Equation 24}$$

To get a flat phase front that rotates as the input φ changes the following is needed:

$$Phase_i = K\varphi y_i \text{ or } \left(G_m + G_n + \frac{\gamma_i\alpha_m - \kappa_i\alpha_n}{\gamma_j\alpha_m + \kappa_i\alpha_n}\right) = Ky_i \quad \text{Equation 26}$$

Where $y_1$ is a distance of the ith antenna element from an antenna array centre and K is a constant.

By choosing gearing ratios of tilt vectors to be integer ascending ratios (easily achieved in a tilt controller) the criterion for the tilt vectors can be fulfilled and by choosing the ratios $\gamma_i$, $\kappa_i$, connecting element i to the tilt vectors M and N the criterion at every element can be achieved.

This generates a substantially flat phase front for tilting of the phased array antenna as φ increases; it also provides optimum phase front linearity when the corporate feed 206 combines only tilt vectors that are adjacent. The phase front is perfectly flat as long as φ is small (lemma 2). Moreover, it allows the tilt controller 204 and the corporate feed 206 to be implemented as a circuit of planar form without track cross-overs, as described with reference to FIGS. 7, 8 and 9.

Referring now to FIG. 15, an antenna system 300 of the invention is shown which is suitable for operation in both transmit and receive modes. In this embodiment of the invention, two separate tilt controllers, i.e. a transmit tilt controller 302T and a receive tilt controller 302R, are used for transmit and receive signals respectively. Transmit and receive signals pass between the tilt controllers 302T and 302R and a common corporate feed 304 via duplex (i.e. transmit/receive) filter units 306A, 306B, 306C etc. associated with tilt vector signals A, B and C etc. These filter units separate transmit signals passing to the right from receive signals passing to the left: they route transmit signals from the transmit tilt controller 302T to the corporate feed 304, and receive signals from the corporate feed 304 to the receive tilt controller 302R. Lines 308 and a duplex filter unit 306X shown dotted in each case indicate that as many filter units 306A, 306B, 306C and tilt vector signals may be employed as desired. The corporate feed 304 provides antenna element drive signals to antenna elements (indicated by triangles) of an antenna array 310 in transmit mode, and in receive mode the corporate feed 304 obtains from the antenna array 310 signals received by antenna elements from free space. The antenna system 300 achieves an electrical tilt range of 10 degrees far a maximum side lobe level of −18 dB.

Strictly speaking, tilt vector signals A, B and C etc. are defined for control of electrical tilt by a transmitter in transmit mode rather than a receiver in receive mode, because they have been described as being generated in a tilt controller from a single input signal V by splitting and delay operations before passing to a corporate feed. In receive mode, signals are received from free space by antenna elements of an antenna array such as 310, and these received signals pass in the reverse direction from antenna elements to a corporate feed. However, in the embodiments of the invention described earlier, components of each tilt controller and corporate feed operate for a receiver in receive mode in a similar manner to that in transmit mode but in reverse: i.e. splitters become signal combiners and sum and difference hybrids exchange their inputs and outputs. Signals received by antenna elements therefore become combined by a corporate feed 64, 104, 124 or 304 into composite signal vectors A, B and C etc. These composite signal vectors are now designated for convenience as intermediate tilt signals instead of tilt control signals (in fact both intermediate tilt signals and tilt control signals are intermediate signals): they pass into a tilt controller 62, 102, 122 or 302R for variable delay and combining at e.g splitters S1 and S2 in FIG. 5 which now act as combiners. This controls the antenna array's angle of electrical tilt in receive mode, and results in a single output signal V for that angle.

The transmit and receive tilt controllers 302T and 302R both have variable delays (not shown) as described in earlier embodiments; the delays in transmit tilt controller 302T are separate and independently variable of those in receive tilt controller 302R. The controllers 302T and 302R both control the antenna array's angle of electrical tilt, one in transmit mode and the other in receive mode. Consequently, the antenna system 300 of the invention provides separate independently variable angles of tilt in transmit and receive modes of operation.

Alternatively, one of the tilt controllers 302T or 302R may be used for a first pair of transmit and receive signals (TX1, RX1) and the other tilt controller for a second pair of transmit and receive signals (TX2, RX2). In this case the duplex filter units 306A, 306B, 3060 etc. are replaced with band combining filters.

As a further alternative, multiple tilt controllers 302T and 302R may be used for multiple transmit signals at different frequencies (TX1, TX2, . . . ) or for multiple receive signals at different frequencies (RX1, RX2, . . . ). In this case the duplex filter units 306A, 306B, 306C etc. are replaced with band pass filters which isolate different transmit or receive frequencies.

Embodiments of the invention provide an electrically tiltable antenna which:

(a) for We antenna elements in a phased array antenna, has from two to (Ne−2) variable delays, whereas the prior art uses one or (Ne−1) variable delays;
(b) may be designed to have the minimum aggregate time delay for a given number of antenna elements, range of tilt and side lobe level;
(c) may be designed to have variable delays with the same maximum value of delay;
(d) maintains good linearity of phase taper over its range of electrical tilt;
(e) has good achievable gain for a given level of side lobes;
(f) has a gain that remains substantially constant over its range of electrical tilt;
(g) may be designed for any number of antenna elements;

(h) may be designed to have a lossless corporate feed, other than unavoidable losses associated with components having non-ideal properties;

(i) may be designed without circuit cross-overs in microstrip or tri-plate; and (j) has sufficiently few variable delays to allow antenna sharing between a number of carrier frequencies or operators with an individual angle of tilt for each.

The delay utilisation of the invention is compared with that of the prior art in FIG. 16, in which delay requirements are plotted against number of antenna elements in an antenna array used with electrical tilting. Here Total Time Delay Requirement (ordinate, ΣT) is the total delay introduced by all phase shifters in order to tilt the antenna array maximally; e.g. if a four element antenna array required phase shifters introducing delays of (0, T, 2T and 3T) then the total delay requirement to maximally tilt the antenna array is 6T.

The invention provides a range of antenna systems with more than a single variable delay (see e.g. WO 2004/102739 and FIG. 4), but at least two fewer variable delays than antenna elements (compared to one fewer in the prior art of FIGS. 2(A) to 2(D) and 3(A) to (C)). In this connection the range of the invention is a region indicated by a bidirectional arrow 400, the prior art of WO 2004/102739 by a horizontal line 400 and that of FIGS. 2(A) to 2(D) and 3(A) to (C) by a bidirectional arrow 404. The invention is therefore superior as regards delay requirements to the prior art described with reference to FIGS. 2(A) to 2(D) and 3(A) to 3(C), and it is superior to the prior art of WO 2004/102739 as regards obtainable range electrical tilt and beam shape at the expense of less additional delay than the other prior art.

In all of the embodiments of the invention described above, splitter ratios may be adjusted to configure signal amplitudes to implement amplitude taper for antenna beam shaping. Commonly used amplitude taper functions include:

(a) Cosine squared on a pedestal amplitude taper, used for low side lobe levels;

(b) Dolph-Chebyshev amplitude taper, used for maximum gain from equal side lobe levels; and (c) specialised amplitude tapers used e.g. for equal ground illumination or null steering.

Embodiments of the invention described above have variable delays (e.g. TA, TB, TD, TE in FIG. 12) controlled in a linear way with an integer (typically unity) relationship. These delays may be set from any specific control relationship so that tilt vectors e.g. A to D obtained from an input signal vector V are given by relations of the form:

$$A=a_a V(\text{angle}(F(G_a(\varphi))\varphi)) \quad \text{Equation 22}$$

$$B=a_b V(\text{angle}(F(G_b(\varphi))\varphi)) \quad \text{Equation 23}$$

$$C=a_c V(\text{angle}(F(G_c(\varphi))\varphi)) \quad \text{Equation 24}$$

$$D=a_d V(\text{angle}(F(G_d(\varphi))\varphi)) \quad \text{Equation 25}$$

where $\alpha_a$, $\alpha_b$, $\alpha_c$ and $\alpha_d$ are amplitude scaling factors for tilt vectors A, B, C and D, and $G_a$, $G_b$, $G_c$ and $G_d$ are angle scaling factors for tilt vectors A, B, C and D, and φ is a requested tilt angle for the antenna.

This allows control of antenna beam shape to provide, for example, side lobe level control over the tilt range, gain control and null-filling and null steering.

Further control of antenna beam shape can be obtained by adjustment of splitter ratios in a tilt controller and a corporate feed (see embodiments of the invention above) as a function of electrical tilt angle.

Dynamic control of the split ratio of a splitter can be implemented with a time delay device coupled to a hybrid combiner as described in WO/2004/088790.

A tilt controller may be mounted locally to an antenna array, e.g. within a radome in which the tilt controller, corporate feed and antenna array are located; it may alternatively be located remotely from the antenna array, i.e. either near a base station using the antenna array or integrally as part of the modulation functions within the base station.

The invention claimed is:

1. A phased array antenna system with electrical tilt control operative as a receiver in receive mode, comprising:

an array of antenna elements;

a corporate feed for processing received signals from antenna elements to produce at least first, second and third intermediate signals at least partly comprising vector combinations of the received signals, wherein at least one of the received signals comprises the third intermediate signal;

a tilt controller for converting the intermediate signals into an output signal by variably delaying the first and second intermediate signals relative to the third intermediate signal and combining the delayed intermediate signals with the third intermediate signal to provide the output signal, wherein the third intermediate signal receives no variable delay, wherein the tilt controller includes variable delays for variably delaying each of the first and second intermediate signals relative to the third intermediate signal, the variable delays being arranged to provide delays which vary at like rates and where one of the delays increases while another of the delays reduces; and wherein the corporate feed and the tilt controller are for steering a beam of the array of antenna elements in response to the delays of the first and second intermediate signals relative to the third intermediate signal.

2. The phased array antenna system according to claim 1 wherein the variable delays are arranged to apply the delays which are equal to one another in magnitude.

3. The phased array antenna system according to claim 1, wherein the corporate feed is arranged to combine signals in neighbouring locations to avoid circuit cross-overs.

4. The phased array antenna system according to claim 1 wherein the corporate feed is arranged to combine signals in neighbouring locations to produce drive signals for the array of antenna elements and to avoid circuit cross-overs.

5. The phased array antenna system according to claim 1 wherein the tilt controller and the corporate feed are arranged for the corporate feed to receive the received signals from the array of antenna elements with a substantially linear phase front across the array of antenna elements.

6. The phased array antenna system according to claim 1 wherein the tilt controller and the corporate feed are arranged for the corporate feed to receive the received signals from the array of antenna elements with an amplitude taper which suppresses side lobes of the beam of the array of antenna elements and with a substantially linear phase taper which tilts the beam of the array of antenna elements without compromising a shape of the beam.

7. The phased array antenna system according to claim 1 wherein the tilt controller is a first tilt controller, and the system includes at least one other tilt controller and a filter to isolate at least one of transmit signals or receive signals of different frequencies and to provide a respective independent angle of electrical tilt associated with each of the tilt controllers.

8. The phased array antenna system according to claim 1 wherein the tilt controller and the corporate feed include a plurality of splitters implementing an amplitude taper, wherein the amplitude taper comprises one of: a cosine, cosec or Dolph-Chebyshev amplitude taper.

9. The phased array antenna system according to claim 1 wherein the tilt controller includes only two variable delays for variably delaying only the first and second intermediate signals relative to the third intermediate signal.

10. The phased array antenna system according to claim 1 wherein the tilt controller includes only four variable delays for variably delaying only the first and second intermediate signals, a fourth intermediate signal and a fifth intermediate signal relative to the third intermediate signal.

11. The phased array antenna system according to claim 1 wherein the array of antenna elements has seven, eleven, fifteen or nineteen antenna elements.

12. The phased array antenna system according to claim 1 wherein the tilt controller and the corporate feed include double box quadrature hybrids and sum and difference hybrids for splitting and combining signals.

13. The phased array antenna system according to claim 1 wherein some of the received signals are fractions of individual intermediate signals and other of the received signals are vector sums or differences of fractions of two of the intermediate signals.

14. A method of operating a phased array antenna system with electrical tilt control as a receiver in receive mode, the antenna system incorporating an antenna with an array of antenna elements and the method comprising:

processing, by the phased array antenna system, received signals from antenna elements to produce at least first, second and third intermediate signals at least partly comprising vector combinations of the received signals, wherein at least one of the received signals comprises the third intermediate signal;

converting, by the phased array antenna system, the intermediate signals into an output signal by variably delaying the first and second intermediate signals relative to the third intermediate signal and combining the delayed intermediate signals with the third intermediate signal to provide the output signal, wherein the third intermediate signal receives no variable delay, wherein the variably delaying comprises variably delaying each of the first and second intermediate signals relative to the third intermediate signal with delays which vary at like rates, and where one of the delays increases while another of the delays reduces; and wherein the processing and the converting are for steering a beam of the array of antenna elements in response to the delays of the first and second intermediate signals relative to the third intermediate signal.

15. The method of operating a phased array antenna system according to claim 14 wherein the variably delaying applies the respective delays which are equal to one another in magnitude.

16. The method of operating a phased array antenna system according to claim 14 including combining signals in neighbouring locations to avoid circuit cross-overs.

17. The method of operating a phased array antenna system according to claim 14 including combining signals in neighbouring locations to produce drive signals for the array of antenna elements and to avoid circuit cross-overs.

18. The method of operating a phased array antenna system according to claim 14 including receiving the received signals from the array of antenna elements with a substantially linear phase front across the array of antenna elements.

19. The method of operating a phased array antenna system according to claim 14 including receiving the received signals from the array of antenna elements with an amplitude taper which suppresses side lobes of the beam of the array of antenna elements and with a substantially linear phase taper which tilts the beam of the array of antenna elements without compromising a shape of the beam.

20. The method of operating a phased array antenna system according to claim 14 including isolating at least one of transmit or receive signals of different frequencies to provide independent angles of electrical tilt associated with different tilt controls.

21. The method of operating a phased array antenna system according to claim 14 including signal splitting to implement an amplitude taper wherein the amplitude taper comprises one of: a cosine, cosec or Dolph-Chebyshev amplitude taper.

22. The method of operating a phased array antenna system according to claim 14 including variably delaying only the first and second intermediate signals relative to the third intermediate signal.

23. The method of operating a phased array antenna system according to claim 14 including variably delaying only the first and second intermediate signals, a fourth intermediate signal and a fifth intermediate signal relative to the third intermediate signal.

24. The method of operating a phased array antenna system according to claim 14 wherein the array of antenna elements has seven, eleven, fifteen or nineteen antenna elements.

25. The method of operating a phased array antenna system according to claim 14 including splitting and combining signals via double box quadrature hybrids and sum and difference hybrids.

26. The method of operating a phased array antenna system according to claim 14 wherein some of the received signals are fractions of individual intermediate signals and other of the received signals are vector sums or differences of fractions of two of the intermediate signals.

* * * * *